US012745888B1

(12) United States Patent
Copeland et al.

(10) Patent No.: US 12,745,888 B1
(45) Date of Patent: Sep. 29, 2026

(54) EXTRACTION CLEANER WITH CLEANING AND DEBRIS SEPARATION

(71) Applicant: SharkNinja Operating LLC, Needham, MA (US)

(72) Inventors: Philippa Joy Copeland, Hampshire (GB); Robert Mueller, London (GB); Oliver Holmes, London (GB); Ethan Ames, Chestnut Hill, MA (US); Luis Herrick Vasconcelos e Souza, Brookline, MA (US); Mitchell Galloway, Shifnal (GB); Zachary Shonfeld, Cambridge, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 19/380,539

(22) Filed: Nov. 5, 2025

(51) Int. Cl.
*A47L 11/40* (2006.01)
*A47L 7/00* (2006.01)

(52) U.S. Cl.
CPC ..... *A47L 11/4088* (2013.01); *A47L 7/0019* (2013.01)

(58) Field of Classification Search
CPC ..... A47L 11/4088; A47L 11/4083; A47L 11/408; A47L 11/4041; A47L 7/0019
See application file for complete search history.

(56) References Cited

U.S. PATENT DOCUMENTS

| | | | |
|---|---|---|---|
| 4,330,899 A | 5/1982 | Miller et al. | |
| 4,655,694 A | 4/1987 | Berfield | |
| 4,665,581 A | 5/1987 | Oberdorfer | |
| 5,155,876 A | 10/1992 | Whitaker | |
| 5,159,738 A | 11/1992 | Sunagawa et al. | |
| 5,289,612 A | 3/1994 | Glenn, III | |
| 6,192,548 B1 * | 2/2001 | Huffman | A47L 11/4088 15/320 |
| 6,804,857 B1 | 10/2004 | Olewiler, III | |
| 6,832,407 B2 | 12/2004 | Salem et al. | |
| 6,954,966 B2 | 10/2005 | Shimizu et al. | |
| 7,210,195 B2 | 5/2007 | Howie et al. | |
| 7,425,225 B2 | 9/2008 | Genn et al. | |
| 7,434,293 B2 | 10/2008 | Park | |
| 7,547,336 B2 | 6/2009 | Fester et al. | |
| 7,690,077 B2 | 4/2010 | Biere | |
| 7,708,789 B2 | 5/2010 | Fester | |
| 7,770,256 B1 | 8/2010 | Fester | |
| 7,774,898 B2 | 8/2010 | Hong et al. | |

(Continued)

FOREIGN PATENT DOCUMENTS

| | | |
|---|---|---|
| CN | 1069458 C | 8/2001 |
| CN | 101191499 A | 6/2008 |

(Continued)

*Primary Examiner* — Andrew A Horton

(74) *Attorney, Agent, or Firm* — Mintz, Levin, Cohn, Ferris, Glovsky and Popeo, P.C. US

(57) ABSTRACT

The present disclosure provides a cleaning device comprising a body, a suction source, and a suction head operably coupled to the body and defining at least one suction opening in fluid communication with the suction source. The suction opening intakes debris from a surface to be cleaned. The suction head comprises a wall, an agitator configured to agitate the surface, and a fluid dispenser configured to dispense fluid onto a portion of the wall prior to making contact with the surface.

17 Claims, 15 Drawing Sheets

(56) References Cited

U.S. PATENT DOCUMENTS

| | | | |
|---|---|---|---|
| 7,921,506 | B2 | 4/2011 | Baek et al. |
| 8,448,293 | B2 | 5/2013 | Sepke |
| 8,695,159 | B2 | 4/2014 | Van Der Kooi et al. |
| 9,011,564 | B2 | 4/2015 | de Wit et al. |
| 9,155,437 | B2 | 10/2015 | Williams et al. |
| 9,307,881 | B2 | 4/2016 | Salo et al. |
| 9,339,160 | B2 | 5/2016 | Petersen et al. |
| 9,402,521 | B2 | 8/2016 | Bassett et al. |
| 9,402,522 | B2 | 8/2016 | Bassett et al. |
| 9,456,726 | B2 | 10/2016 | Reed et al. |
| 9,554,682 | B2 | 1/2017 | Van Der Kooi et al. |
| 9,585,535 | B2 | 3/2017 | Morgan et al. |
| 9,693,662 | B2 | 7/2017 | Tadina et al. |
| 9,782,049 | B2 | 10/2017 | York et al. |
| 9,833,116 | B2 | 12/2017 | Huang et al. |
| 9,883,782 | B2 | 2/2018 | York et al. |
| 10,130,230 | B2 | 11/2018 | Moser et al. |
| 10,165,916 | B2 | 1/2019 | Morphey et al. |
| 10,299,646 | B2 | 5/2019 | Hyun et al. |
| 10,362,912 | B2 | 7/2019 | Hyun et al. |
| 10,398,268 | B2 | 9/2019 | Krebs et al. |
| 10,406,535 | B2 | 9/2019 | Ni |
| 10,413,853 | B2 | 9/2019 | Kawamoto et al. |
| 10,555,651 | B2 | 2/2020 | Williams et al. |
| 10,610,071 | B2 | 4/2020 | Hu et al. |
| 10,729,298 | B2 | 8/2020 | Cho |
| 10,791,900 | B2 | 10/2020 | Tran et al. |
| 10,813,512 | B2 | 10/2020 | Cho et al. |
| 10,874,270 | B2 | 12/2020 | Larsen et al. |
| 11,089,933 | B2 | 8/2021 | Xia et al. |
| 11,089,935 | B2 | 8/2021 | Nguyen |
| 11,109,728 | B2 | 9/2021 | Lee |
| 11,122,946 | B2 | 9/2021 | Nguyen |
| 11,172,801 | B2 | 11/2021 | Pohlman et al. |
| 11,173,427 | B2 | 11/2021 | Bayati et al. |
| 11,206,962 | B1 | 12/2021 | Tam |
| 11,317,774 | B2 | 5/2022 | Yun et al. |
| 11,395,570 | B2 | 7/2022 | Cebasek et al. |
| 11,452,411 | B2 | 9/2022 | Lee et al. |
| 11,517,166 | B2 | 12/2022 | Percy-Raine et al. |
| 11,638,509 | B2 | 5/2023 | Ryu et al. |
| 11,684,687 | B2 | 6/2023 | Chang et al. |
| 11,772,023 | B2 | 10/2023 | Tam |
| 11,832,781 | B2 | 12/2023 | Han et al. |
| 11,844,482 | B2 | 12/2023 | Zhang et al. |
| 11,844,487 | B2 | 12/2023 | Kim et al. |
| 11,857,052 | B2 | 1/2024 | Conrad |
| 11,903,548 | B2 | 2/2024 | Conrad |
| 11,950,754 | B2 | 4/2024 | Truitt et al. |
| 11,963,652 | B2 | 4/2024 | Percy-Raine et al. |
| 11,963,654 | B2 | 4/2024 | Nam et al. |
| 11,992,167 | B2 | 5/2024 | Conrad |
| 12,011,141 | B2 | 6/2024 | Seo et al. |
| 12,048,402 | B2 | 7/2024 | Luyckx et al. |
| 12,144,483 | B2 | 11/2024 | Royale et al. |
| 12,167,826 | B2 | 12/2024 | Thomas |
| 12,171,391 | B2 | 12/2024 | Zhang et al. |
| 12,185,889 | B2 | 1/2025 | Diana et al. |
| 12,193,622 | B2 | 1/2025 | Resch et al. |
| 12,201,251 | B2 | 1/2025 | Terry et al. |
| 2006/0254022 | A1 | 11/2006 | Oh et al. |
| 2006/0257269 | A1 | 11/2006 | Lee et al. |
| 2006/0277711 | A1 | 12/2006 | Hong et al. |
| 2013/0133155 | A1 | 5/2013 | Perez |
| 2022/0183518 | A1 | 6/2022 | Amoretti |
| 2022/0257071 | A1 | 8/2022 | Zheng et al. |
| 2023/0022866 | A1 | 1/2023 | Heo |
| 2023/0033367 | A1* | 2/2023 | Hale ..... A47L 11/4088 |
| 2023/0039475 | A1 | 2/2023 | Al-Shorachi et al. |
| 2023/0165418 | A1 | 6/2023 | Braendle |
| 2023/0320546 | A1 | 10/2023 | Al-Shorachi et al. |
| 2023/0337879 | A1 | 10/2023 | Percy-Raine et al. |
| 2023/0397788 | A1 | 12/2023 | Yang |
| 2024/0032758 | A1 | 2/2024 | Moyher, Jr. et al. |
| 2024/0115097 | A1 | 4/2024 | Lee et al. |
| 2024/0148206 | A1 | 5/2024 | Jang et al. |
| 2024/0268619 | A1 | 8/2024 | Huang et al. |
| 2024/0315514 | A1 | 9/2024 | Nguyen et al. |
| 2024/0324837 | A1 | 10/2024 | Kang et al. |
| 2024/0335078 | A1 | 10/2024 | Nguyen |
| 2024/0349969 | A1 | 10/2024 | Nguyen et al. |
| 2025/0107679 | A1 | 4/2025 | Kozlowski, Jr. et al. |

FOREIGN PATENT DOCUMENTS

| | | | |
|---|---|---|---|
| CN | 100556352 | C | 11/2009 |
| CN | 101904719 | B | 7/2012 |
| CN | 103479297 | A | 1/2014 |
| CN | 102018474 | B | 12/2014 |
| CN | 204734437 | U | 11/2015 |
| CN | 103445717 | B | 6/2016 |
| CN | 205306913 | U | 6/2016 |
| CN | 103767627 | B | 8/2016 |
| CN | 104398211 | B | 12/2016 |
| CN | 104519780 | B | 2/2017 |
| CN | 107536579 | A | 1/2018 |
| CN | 208876377 | U | 5/2019 |
| CN | 208926214 | U | 6/2019 |
| CN | 209066353 | U | 7/2019 |
| CN | 209066360 | U | 7/2019 |
| CN | 110192808 | A | 9/2019 |
| CN | 209915866 | U | 1/2020 |
| CN | 110996738 | A | 4/2020 |
| CN | 210277078 | U | 4/2020 |
| CN | 210277083 | U | 4/2020 |
| CN | 210493951 | U | 5/2020 |
| CN | 210643878 | U | 6/2020 |
| CN | 112450797 | A | 3/2021 |
| CN | 112656284 | A | 4/2021 |
| CN | 112656286 | A | 4/2021 |
| CN | 112656288 | A | 4/2021 |
| CN | 112656295 | A | 4/2021 |
| CN | 112741551 | A | 5/2021 |
| CN | 112773247 | A | 5/2021 |
| CN | 112890665 | A | 6/2021 |
| CN | 113273923 | A | 8/2021 |
| CN | 113273924 | A | 8/2021 |
| CN | 113303701 | A | 8/2021 |
| CN | 213850468 | U | 8/2021 |
| CN | 113413084 | A | 9/2021 |
| CN | 214510981 | U | 10/2021 |
| CN | 214510982 | U | 10/2021 |
| CN | 214510997 | U | 10/2021 |
| CN | 214511000 | U | 10/2021 |
| CN | 214511002 | U | 10/2021 |
| CN | 214511003 | U | 10/2021 |
| CN | 214595755 | U | 11/2021 |
| CN | 214712322 | U | 11/2021 |
| CN | 215016758 | U | 12/2021 |
| CN | 215077987 | U | 12/2021 |
| CN | 215348671 | U | 12/2021 |
| CN | 215348672 | U | 12/2021 |
| CN | 215383671 | U | 1/2022 |
| CN | 215383684 | U | 1/2022 |
| CN | 215424444 | U | 1/2022 |
| CN | 215457598 | U | 1/2022 |
| CN | 215534052 | U | 1/2022 |
| CN | 110996744 | B | 3/2022 |
| CN | 110996745 | B | 3/2022 |
| CN | 215937213 | U | 3/2022 |
| CN | 216090302 | U | 3/2022 |
| CN | 216090304 | U | 3/2022 |
| CN | 112690691 | B | 4/2022 |
| CN | 112716355 | B | 4/2022 |
| CN | 112716356 | B | 4/2022 |
| CN | 216167201 | U | 4/2022 |
| CN | 112690692 | B | 5/2022 |
| CN | 112674635 | B | 6/2022 |
| CN | 113749555 | B | 6/2022 |
| CN | 217218891 | U | 8/2022 |
| CN | 115005708 | A | 9/2022 |
| CN | 217447558 | U | 9/2022 |
| CN | 217447574 | U | 9/2022 |
| CN | 217447575 | U | 9/2022 |

(56) References Cited

FOREIGN PATENT DOCUMENTS

| | | | |
|---|---|---|---|
| CN | 217592764 | U | 10/2022 |
| CN | 217645111 | U | 10/2022 |
| CN | 217645117 | U | 10/2022 |
| CN | 217645118 | U | 10/2022 |
| CN | 217827719 | U | 11/2022 |
| CN | 112932358 | B | 12/2022 |
| CN | 217987445 | U | 12/2022 |
| CN | 218128393 | U | 12/2022 |
| CN | 113768406 | B | 1/2023 |
| CN | 115670320 | A | 2/2023 |
| CN | 218484488 | U | 2/2023 |
| CN | 115721205 | A | 3/2023 |
| CN | 218552216 | U | 3/2023 |
| CN | 218635907 | U | 3/2023 |
| CN | 218922447 | U | 4/2023 |
| CN | 218922461 | U | 4/2023 |
| CN | 114794964 | B | 5/2023 |
| CN | 115227134 | B | 5/2023 |
| CN | 116172468 | A | 5/2023 |
| CN | 219089080 | U | 5/2023 |
| CN | 219089081 | U | 5/2023 |
| CN | 219089123 | U | 5/2023 |
| CN | 115251758 | B | 6/2023 |
| CN | 116269097 | A | 6/2023 |
| CN | 116269104 | A | 6/2023 |
| CN | 116327030 | A | 6/2023 |
| CN | 114886341 | B | 7/2023 |
| CN | 116369781 | A | 7/2023 |
| CN | 116392050 | A | 7/2023 |
| CN | 116407041 | A | 7/2023 |
| CN | 116458811 | A | 7/2023 |
| CN | 219516137 | U | 8/2023 |
| CN | 219594505 | U | 8/2023 |
| CN | 116784717 | A | 9/2023 |
| CN | 219982796 | U | 11/2023 |
| CN | 117243524 | A | 12/2023 |
| CN | 114631757 | B | 1/2024 |
| CN | 115067830 | B | 1/2024 |
| CN | 115381333 | B | 1/2024 |
| CN | 108403035 | B | 3/2024 |
| CN | 115316879 | B | 4/2024 |
| CN | 116098532 | B | 4/2024 |
| CN | 117918744 | A | 4/2024 |
| CN | 117918753 | A | 4/2024 |
| CN | 220937906 | U | 5/2024 |
| CN | 115253492 | B | 6/2024 |
| CN | 118161085 | A | 6/2024 |
| CN | 109253109 | B | 7/2024 |
| CN | 118844885 | A | 10/2024 |
| CN | 115089068 | B | 12/2024 |
| CN | 119326332 | A | 1/2025 |
| DE | 556550 | C | 8/1932 |
| EP | 1969984 | A3 | 4/2011 |
| EP | 2023787 | B1 | 8/2012 |
| EP | 2255710 | B1 | 8/2012 |
| EP | 1959809 | B1 | 5/2014 |
| EP | 3560837 | B1 | 4/2020 |
| EP | 3316752 | B1 | 1/2022 |
| EP | 4210459 | A1 | 7/2023 |
| EP | 4233660 | A1 | 8/2023 |
| EP | 4260785 | A1 | 10/2023 |
| EP | 3847939 | B1 | 11/2023 |
| EP | 4351394 | A2 | 4/2024 |
| EP | 4178405 | A4 | 6/2024 |
| EP | 3639714 | B1 | 8/2024 |
| EP | 4144271 | B1 | 9/2024 |
| WO | 03101271 | A1 | 12/2003 |
| WO | 2024037489 | A1 | 2/2024 |
| WO | 2024064786 | A1 | 3/2024 |
| WO | 2024071622 | A1 | 4/2024 |

* cited by examiner

EXTRACTION CLEANER WITH CLEANING AND DEBRIS SEPARATION

FIELD

The present disclosure is generally directed to surface treatment apparatuses and, more specifically, to extraction cleaners.

BACKGROUND

Surface treatment apparatuses are configured to be maneuvered over a surface to be cleaned (e.g., a carpet, a floor, etc.). While being maneuvered over the surface to be cleaned, the surface treatment apparatus can collect debris deposited on the surface to be cleaned. One example of a surface treatment apparatus is an extraction cleaner. An extraction cleaner is configured to apply a liquid to the surface to be cleaned and to suction the applied liquid from the surface to be cleaned.

SUMMARY

Extraction cleaners with features for cleaning and debris separation are provided. Related apparatuses and techniques are also provided.

In one embodiment, a cleaning device includes a body, a suction source, and a suction head operably coupled to the body. The suction head defines at least one suction opening in fluid communication with the suction source. The at least one suction opening can intake debris from a surface to be cleaned. The suction head includes a wall, an agitator configured to agitate the surface to be cleaned, and a fluid dispenser configured to dispense fluid within the suction head prior to making contact with the surface to be cleaned.

One or more of the following features can be included in any feasible combination. For example, the suction head can include a first suction inlet and a second suction inlet, both fluidly coupled to the suction source. In some examples, the first suction inlet is disposed forward of the agitator and the second suction inlet is disposed rearward of the agitator. In some examples, the fluid dispenser can dispense the fluid onto a portion of the wall. In some examples, an angle between the portion of the wall and the surface to be cleaned is between about 0 to about 30 degrees. In some examples, the fluid dispenser is disposed above the portion of the wall. In some examples, a maximum width of the portion of the wall is greater than a maximum width of the agitator. In some examples, the fluid dispenser is a first fluid dispenser, and the suction head further includes a second fluid dispenser. In some examples, a width between the first fluid dispenser and the second fluid dispenser is less than the maximum width of the agitator. In some examples, the fluid dispenser includes a manifold cover and a plurality of spray nozzles integrated within the manifold cover. In some examples, the manifold cover is configured to block at least a portion of the debris from the plurality of spray nozzles.

In another embodiment, a cleaning device includes an upright body and a cleaning head operably coupled to the upright body. The cleaning head can move across a surface to be cleaned and can include at least one suction nozzle configured to draw in debris from the surface to be cleaned and an agitator disposed adjacent to the at least one suction nozzle. The agitator can agitate the surface to be cleaned. The cleaning head can also include a fluid dispenser disposed at a first wall of the cleaning head that can dispense fluid onto a second wall of the cleaning head such that the dispensed fluid spreads over a width of the second wall prior to contacting the surface to be cleaned.

One or more of the following features can be included in any feasible combination. For example, the second wall can be curved and can be positioned vertically above the agitator such that the dispensed fluid flows downward via gravity from the first wall onto the second wall and onto the surface to be cleaned. In some examples, the second wall extends longitudinally along a length of the agitator and includes one or more deflectors positioned beneath the fluid dispenser to promote lateral dispersion of the dispensed fluid. In some examples, the fluid dispenser includes a manifold cover having a plurality of spray nozzles integrated therein, and the spray nozzles can dispense fluid onto the second wall. In some examples, the spray nozzles are spaced apart to distribute fluid across the width of the second wall. In some examples, a maximum width of the second wall is greater than a maximum width of the agitator. In some examples, the fluid dispenser is a first fluid dispenser and the cleaning head further includes a second fluid dispenser. In some examples, a width between the first fluid dispenser and the second fluid dispenser is less than the maximum width of the agitator. In some examples, the at least one suction nozzle includes a first suction inlet disposed forward of the agitator and a second suction inlet disposed rearward of the agitator. In some examples, the cleaning device further includes a diverter valve fluidly coupled to the first suction inlet and the second suction inlet, the diverter valve being selectively configurable to direct suction flow between the first suction inlet and the second suction inlet. In some examples, the fluid dispenser is fluidly coupled to at least one standpipe.

The foregoing general description of the illustrative embodiments and the following detailed description thereof are merely exemplary aspects of the teachings of this disclosure and are not restrictive. The details of one or more variations of the subject matter described herein are set forth in the accompanying drawings and the description below. Other features and advantages of the subject matter described herein will be apparent from the description and drawings, and from the claims.

BRIEF DESCRIPTION OF FIGURES

Non-limiting and non-exhaustive examples are described with reference to the following figures.

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

The following description sets forth exemplary aspects of the present disclosure. It should be recognized, however, that such description is not intended as a limitation on the scope of the present disclosure. Rather, the description also encompasses combinations and modifications to those exemplary aspects described herein.

An extraction cleaner is a type of surface treatment device designed to apply fluid to a surface, agitate the surface to loosen debris, and then remove the fluid and debris through suction. These devices typically include a fluid supply system for dispensing cleaning solution, an agitator for mechanical scrubbing, and a suction system for extracting the used fluid and debris. The coordinated operation of these systems enables deep cleaning of surfaces such as carpets, rugs, and hard flooring. Structurally, an extraction cleaner may include a body that houses key components such as the fluid tanks and suction motor, and a base that interfaces with the surface to be cleaned. In some embodiments, the base may incorporate fluid dispensing nozzles (also referred to herein as "dispensers" or "outlets"), an agitator chamber, and suction inlets to facilitate cleaning operations. Fluid is delivered from the supply tank to the surface, where it is distributed and agitated before being drawn into a recovery tank via a suction pathway. Additional features such as diverter valves, manifolds, access hatches, and debris separators may be included to improve fluid flow, enhance cleaning performance, and simplify maintenance, as will be described herein.

Figure 1A:
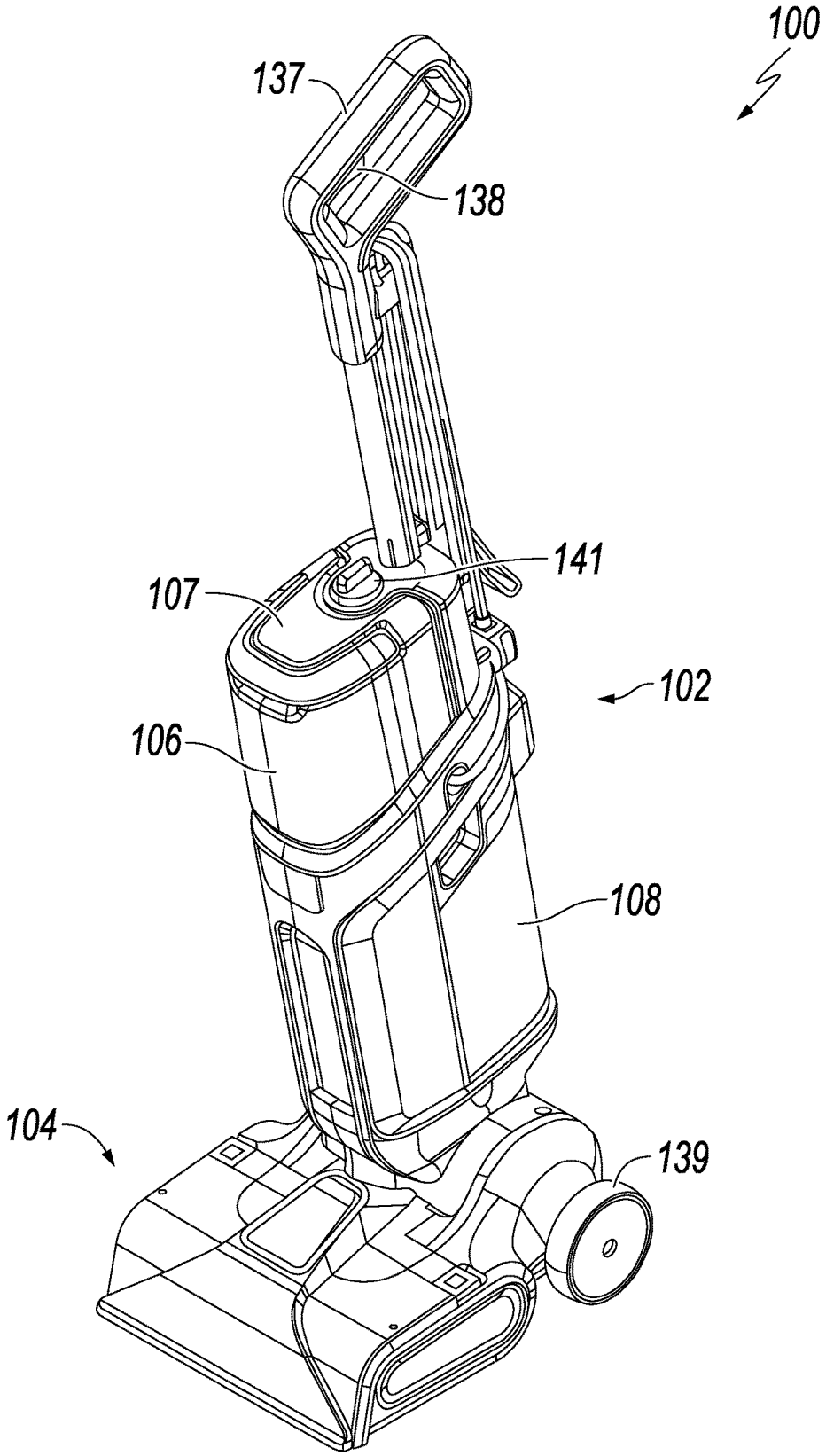
FIG. 1A is a front perspective view of one embodiment of an extraction cleaner.
Figure 1B:
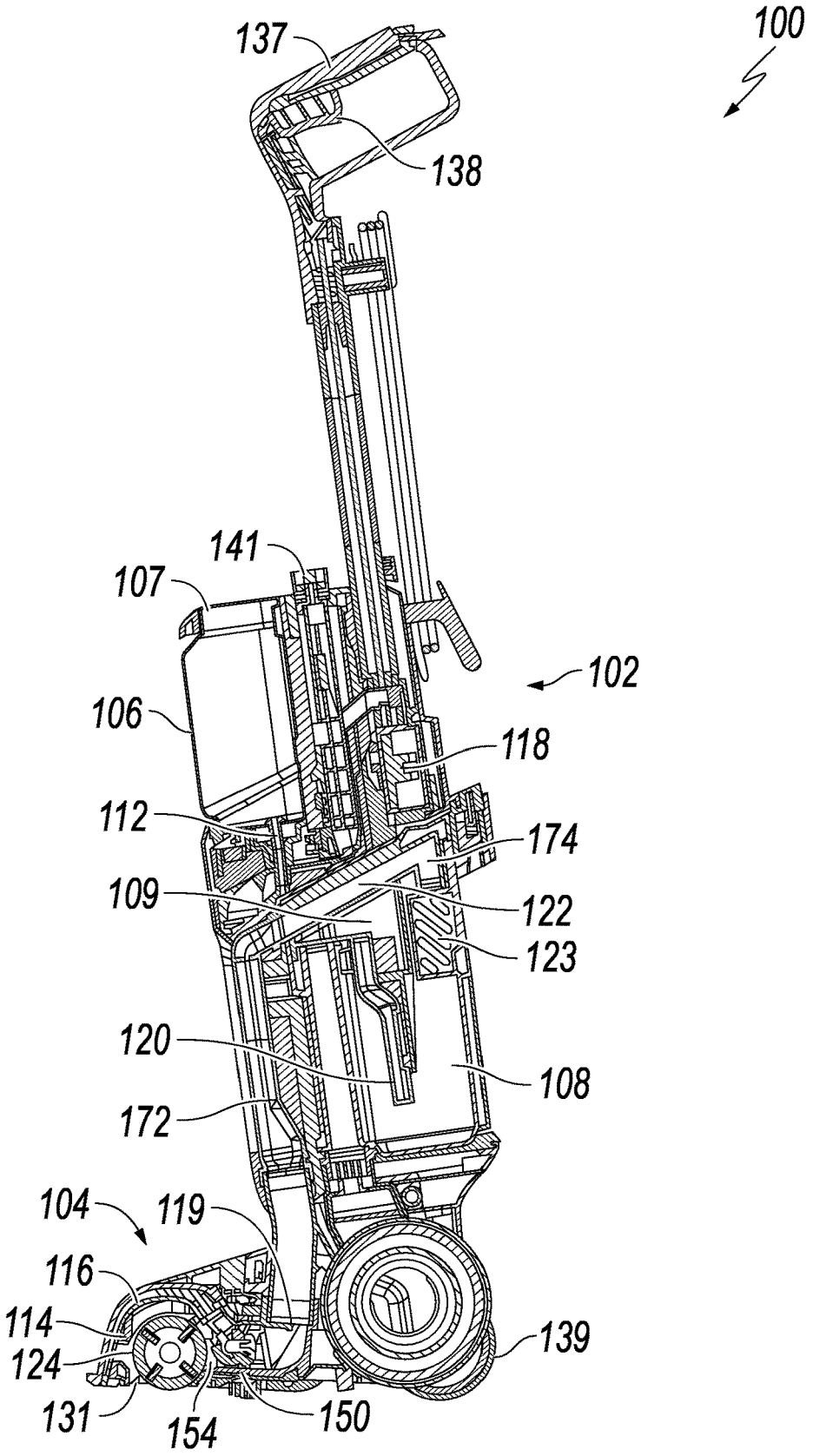
FIG. 1B is a side cross-sectional view of the extraction cleaner of FIG. 1A.
Figure 1C:
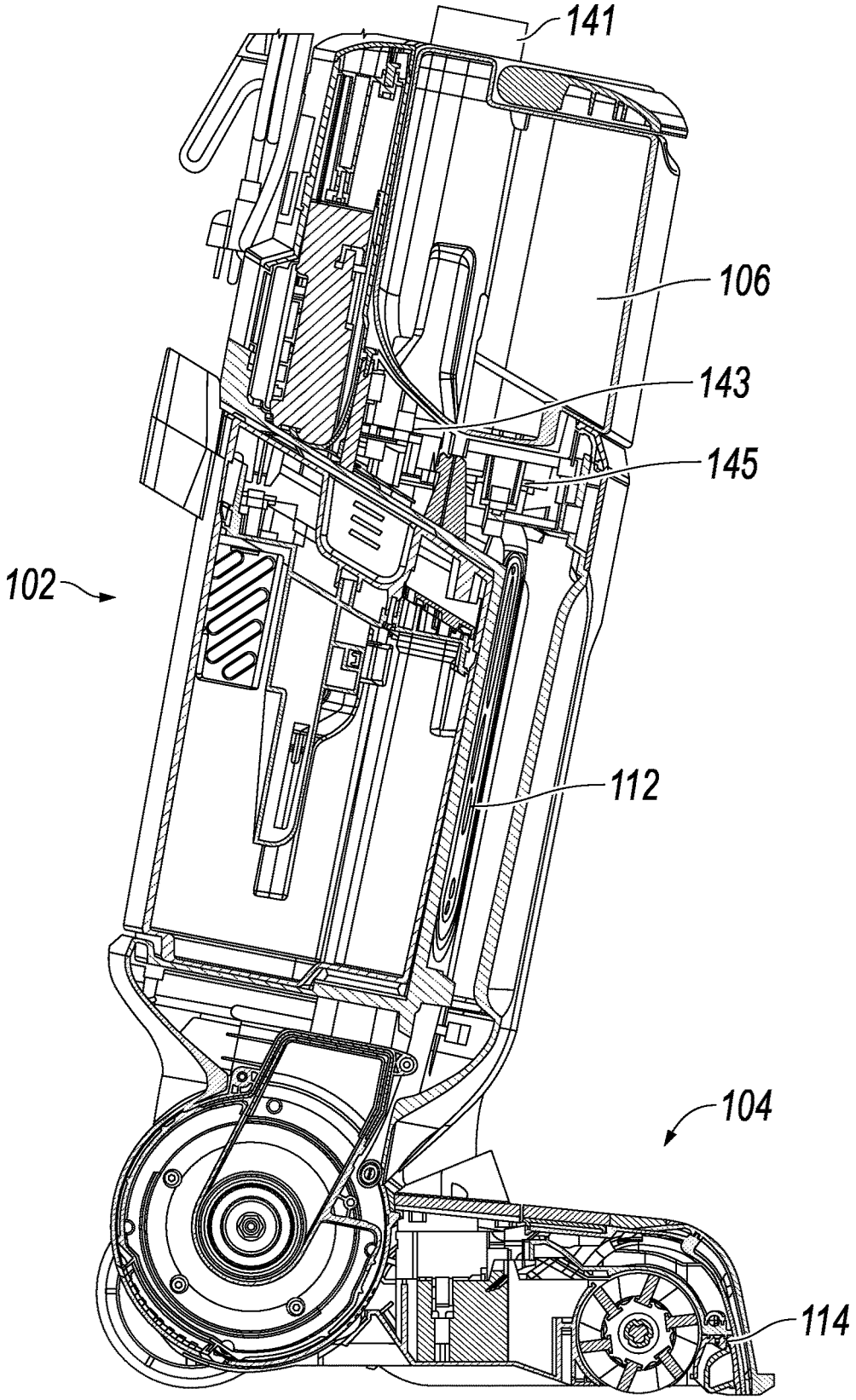
FIG. 1C is a side cross-sectional view of the fluid flow passages of the extraction cleaner of FIG. 1A.

Referring to FIGS. 1A-1C, an extraction cleaner 100 is depicted, according to an embodiment, which may be configured as a floor cleaning device for removing debris and liquid from surfaces. In some embodiments, the extraction cleaner 100 includes an upright body connected to a base (also referred to herein as a "head" and/or "cleaning head") that are operated in conjunction to perform cleaning operations. For example, an upright body 102 that contains various operational components of the extraction cleaner 100 is connected, at its lower end, to a base 104 that contacts a surface (also referred to herein as a "floor") to be cleaned. The upright body 102 may provide structural support for the various components while allowing the extraction cleaner 100 to maintain an upright, angled, and/or reclined configuration during use and storage, as defined relative to the base 104. The upright body 102 may house a suction motor 118 that generates suction flow for drawing fluid and debris from the surface during cleaning operations, with an airflow path 119 extending through the extraction cleaner 100 to connect various components and enable the movement of air, fluid, and debris from the base 104 to the recovery tank 108.

The base 104 may serve as a cleaning head that moves across a surface to be cleaned. The base 104 may be equipped with wheels 139 to enable maneuverability across the surface. The wheels 139 may facilitate movement of the extraction cleaner 100 in multiple directions, allowing users to navigate around furniture and other obstacles during cleaning operations. In some cases, the wheels 139 may be on opposite sides of the base 104 to distribute the weight of the extraction cleaner 100 evenly, reducing the effort required to move the device across the surface. Once the upright body 102 is moved to the reclined position relative to the base 104, the user can grasp the handle 137 and repeatedly push and pull the base 104 in forward and reverse strokes, respectively, along the surface to be cleaned 110.

A handle 137 may be provided at the upper portion of the upright body 102 for maneuvering the extraction cleaner 100 during operation. The handle 137 may include a trigger mechanism 138 for controlling fluid dispensing operations, allowing users to selectively activate the fluid delivery system when cleaning specific areas. In some cases, the trigger mechanism 138 may provide variable control over fluid flow rates, enabling users to adjust the amount of cleaning solution dispensed based on the cleaning requirements of different surfaces. The handle 137 may be ergonomically designed to provide comfortable grip during extended cleaning sessions while maintaining easy access to the trigger mechanism 138.

Fluid sprayed onto the surface to be cleaned can be provided by a fluid supply tank, which can be designed to hold various fluid required for cleaning operations. For example, a fluid supply tank 106 can be located on the extraction cleaner 100, such as on its upright body 102 and/or its base 104. As shown in FIGS. 1A-1C, the fluid supply tank 106 may be positioned on the upright body 102. The location of the fluid supply tank 106 can be chosen to help maintain balanced weight distribution and ergonomic handling during operation of the extraction cleaner 100. In some embodiments, the fluid supply tank 106 may include a removable cap 107 for filling operations. The removable cap 107 may allow users to add cleaning solution(s) and/or water to the fluid supply tank 106 without requiring disassembly of other components. In some cases, the fluid supply tank 106 may be configured to hold various types of cleaning fluids, such as water, detergent, soap, a fragrance, and/or other cleaning fluid. The positioning of the fluid supply tank 106 on the upright body 102 may provide easy access for refilling while maintaining proper weight distribution throughout the extraction cleaner 100.

Fluid supply lines can connect the fluid supply tank 106 to other fluid-handling components of the extraction cleaner 100. For example, as shown in FIGS. 1B and 1C, one or more supply lines 112 can connect the fluid supply tank 106 to the base 104 for dispensing fluid during cleaning. In some embodiments, the supply lines 112 are fluidly coupled to one or more fluid dispensing nozzles 114 coupled to the base 104. Fluid from the supply lines 112 can thus be dispensed through the fluid dispensing nozzles 114 directly and/or indirectly onto the surface to be cleaned. In some embodiments, the fluid dispensing nozzles 114 can be disposed within an agitator chamber 116 defined within the base 104.

The agitator chamber 116 may house various cleaning components for surface treatment, such as an agitator 124 disposed in the agitator chamber 116. In some embodiments, the agitator chamber 116 includes an open bottom at the bottom of the base 104 facing the surface to be cleaned. The fluid dispensing nozzles 114 can be positioned adjacent the top wall and near the front wall of the agitator chamber 116. Additionally, or alternatively, the nozzles 114 can be disposed on an external surface of the base 104. In some embodiments, the nozzles 114 can be used to dispense fluid onto a cleaning component (e.g., the agitator 124) located on the base 104. In some embodiments, fluid can be dispensed directly onto the cleaning component, or indirectly onto an intermediate component (e.g., a manifold) that distributes cleaning solution(s) onto the cleaning component. An example of one such intermediate component, waterfall manifold 255, is described herein with respect to FIG. 2A.

To enhance cleaning performance, the extraction cleaner 100 can incorporate an agitator that physically engages the surface to be cleaned. Agitators can take various forms, such as brushrolls, beater bars, or rotating pads, and are generally configured to dislodge embedded debris and promote fluid penetration into surface fibers or textures. Referring back to FIGS. 1A-1C, the agitator 124 may be a brushroll rotatably supported within the agitator chamber 116. In some embodiments, the agitator 124 is configured to rotate about a longitudinal axis to agitate the surface during cleaning operations. The agitator 124 can be driven by a motor directly, via direct attachment to the motor, or indirectly, via attachment to a linkage that transfers the movement of the motor into rotation of the agitator 124. An example of one such linkage, belt assembly 365, is described herein with respect to FIG. 3. In some embodiments, the agitator 124 extends from the open bottom of the agitator chamber 116 and is configured to engage and agitate the surface to be cleaned. The agitator 124 may include bristles 125 or cleaning elements arranged around a cylindrical surface for enhanced cleaning action, with the bristles 125 configured to dislodge embedded debris and facilitate fluid penetration into carpet fibers or surface textures. The agitator chamber 116 may provide a contained and/or partially contained environment for the agitator 124 while allowing access to the surface being cleaned through openings in the base 104. In some embodiments, the agitator 124 may have a maximum width that corresponds to 100% of a maximum width of the agitator chamber 116, allowing for comprehensive surface coverage during each pass. In some embodiments, the agitator 124 may have a maximum width of up to 99%, up to 95%, up to 90%, up to 85%, up to 80%, up to 75%, up to 70%, up to 65%, up to 60%, up to 55%, and/or up to 50% of the maximum width of the agitator chamber 116. In some embodiments, the agitator 124 contains bristles 125 that extend beyond an outer edge of the agitator chamber 116, such that the maximum width of the agitator 124 is greater than 100% of the maximum width of the agitator chamber 116. For example, the agitator may have a maximum width of up to 101%, up to 102%, up to 103%, up to 104%, up to 105%, and/or up to 110% of the maximum width of the agitator chamber 116.

Fluid and debris removed from the surface during cleaning operations may be collected in a recovery tank. Suction generated within the extraction cleaner 100 can draw fluid and debris into the tank. For example, a suction motor 118 may be positioned within the upright body 102 and/or the base 104 to provide centralized suction generation throughout the extraction cleaner 100. After the agitator 124 dislodges fluid and/or debris from the surface, the suction motor 118 may draw air, fluid, and/or debris into the recovery tank 108 via the airflow path 119.

During such suction operations, fluid and debris removed from the surface by the suction motor 118 may be collected and stored in a recovery tank. The recovery tank serves as a containment system for the waste materials drawn in by the suction motor 118, preventing re-deposition and enabling easy disposal. For example, the recovery tank 108 may be configured to receive and contain drawn-in fluid and debris collected during cleaning operations. The recovery tank 108 may have an opening that is selectively sealable by a removable lid 109. In some embodiments, the airflow path 119 may extend through the lid 109 of the recovery tank 108 such that liquid and/or debris passes through the lid 109 before entering the recovery tank 108. To empty liquid and/or debris from the recovery tank 108, the lid 109 can be removed, and the waste can be removed from the opening. In some embodiments, the recovery tank 108 may feature a transparent or translucent construction to allow visual monitoring of fluid and debris levels during cleaning operations. The transparent construction may enable users to determine when the recovery tank 108 requires emptying without opening or removing the tank from the upright body 102. In some cases, the recovery tank 108 may be removably coupled to the upright body 102 and/or the base 104, allowing for easy removal and cleaning after use. In some embodiments, the recovery tank 108 contains a float valve 120. The float valve 120 operates by blocking at least a portion of the airflow path 119 (e.g., a suction outlet) from the recovery tank 108. The blockage changes the noise of the extraction cleaner 110 during a suction operation, which can alert a user that the recovery tank 108 is full. In some embodiments, the float valve 120 is disposed near, disposed on, and/or removably coupled to the lid 109.

The extraction cleaner 100 may include various suction inlets which can drawn in fluid and debris from different directions. For example, a nozzle suction inlet 131 may be positioned within the base 104 to draw in fluid and debris from the surface being cleaned. The nozzle suction inlet 131 may be disposed forward of the agitator 124, allowing for debris collection as the extraction cleaner 100 moves across surfaces. Additionally, a chamber suction inlet 154 may be positioned within the agitator chamber 116 to provide suction directly within the chamber area. The chamber suction inlet 154 may be disposed rearward of the agitator 124, creating a secondary suction point that captures debris and fluid that may not be collected by the nozzle suction inlet 131. In some embodiments, the positioning of the nozzle suction inlet 131 forward of the agitator 124 and the chamber suction inlet 154 rearward of the agitator 124 may provide comprehensive debris collection throughout the cleaning path.

The extraction cleaner 100 may include one or more diverter valves to selectively control the direction of suction flow between different suction inlets. The diverter valves allow the cleaner to adjust debris collection to adapt to different cleaning situation. For example, a diverter valve 150 may be fluidly coupled to both the nozzle suction inlet 131 and the chamber suction inlet 154, providing selective control over suction flow distribution. The diverter valve 150 may be movable between a first position in which the nozzle suction inlet 131 is in fluid communication with the suction motor 118 and a second position in which the chamber suction inlet 154 is in fluid communication with the suction motor 118. In this configuration, the diverter valve 150 enables the extraction cleaner 100 to switch between and/or adjust different suction paths depending on the orientation or movement of the device, such as forward or backward strokes. In some embodiments, the agitator 124 may include bristles 125 (see FIG. 2A) that extend outward and/or downward from the base 104 and frictionally engage the surface being cleaned. As the user moves the extraction cleaner 100 forward and backward, the bristles 125 drag relative to the rest of the base 104, creating a mechanical interaction that causes the diverter valve 150 to rotate and change state. This passive actuation mechanism allows the diverter valve 150 to respond dynamically to user movement without requiring manual input or electronic control.

In some cases, the diverter valve 150 may be configured such that when one suction inlet is in fluid communication with the suction motor 118, the other suction inlet is no longer in fluid communication with the suction motor 118 and/or receives a reduced amount of fluid flow. For example, in a first position, the diverter valve 150 may bias the majority of and/or all fluid flow to be from a first suction inlet, and in a second position, the diverter valve 150 may bias the majority of and/or all fluid flow to be from a second suction inlet. At any intermediate positions between the first and second positions, the relative amount of fluid flow between the first and second suction inlets can vary.

The diverter valve 150 may be positioned proximate the agitator chamber 116 within the base 104. In some embodiments, the diverter valve 150 can be covered, at least in part, by a housing of the base 104. Portions of the housing can be removed to access the diverter valve 150 and other internal mechanisms of the base 104. For example, the housing can have a removable hatch through which the diverter valve 150 can be accessed, cleaned, and/or removed. The removable hatch is described herein in greater detail with respect to FIGS. 4A and 4B.

The extraction cleaner 100 can include various conduits and/or ducts to bring in air, liquid, and solid debris. One type of conduit is an upduct, which transports collected debris and liquid from the lower suction inlet(s) of the extraction cleaner 100 to an elevated recovery tank. The upduct may be configured to accommodate changes in elevation and orientation between the suction inlet(s) and the recovery tank, helping maintain consistent airflow and suction performance. Referring back to FIG. 1B, the extraction cleaner includes an upduct 172 that bring in air, liquid, and solid debris into the recovery tank 108. In some embodiments, the upduct 172 may be fluidly coupled to the diverter valve 150 and may extend upward from the base 104 toward the recovery tank 108. This geometry may also promote gravitational separation of liquid and solid debris during transport, improving debris management within the system. The upduct 172 may form a fluid passage that allows drawn-in fluid and debris to travel from the suction inlets to the recovery tank 108 via the airflow path 119. In some embodiments, the upduct 172 may be fluidly coupled to and/or extend through the lid 109 of the recovery tank 108. In some embodiments, the upduct 172 may have a curved or angled configuration that extends upward from the base 104 and then angles backward above the recovery tank 108 to facilitate fluid and/or debris delivery into the recovery tank 108. A down duct 174 may extend downward into the recovery tank 108, providing a pathway for fluid and debris to enter the tank interior. The down duct 174 may be positioned at a rear portion of the recovery tank 108 and may extend vertically downward to direct the incoming fluid and debris toward the bottom of the tank. A debris separator 122 may be disposed along the airflow path 119 downstream of the upduct 172 and upstream of the recovery tank 108. The debris separator 122 may be configured to separate solid debris from liquid as the mixture flows through the system. The ducts and separation features associated with the recovery tank 108 are described in greater detail with respect to FIG. 5.

Referring back to FIGS. 1A-1C, in some embodiments, the extraction cleaner 100 may include a mechanical control dial 141 that provides controls power and fluid dispensing rate from the fluid supply tank 106. The dial 141 may be positioned on a top region of the upright body 102, proximate to and/or on the fluid supply tank 106, allowing users to access both power and flow control functions from a single location. The dial 141 may serve as the primary on/off switch for the extraction cleaner 100 while simultaneously controlling the flow rate of cleaning fluid dispensed from the fluid supply tank 106. In some embodiments, the dial 141 may be configured to press a microswitch when rotated, which may activate the electrical systems of the extraction cleaner 100 and enable operation of the suction motor 118 and other powered components.

The mechanical dial 141 may be operably coupled to a first valve 143 positioned within the fluid flow path between the fluid supply tank 106 and the base 104, enabling direct mechanical control over fluid dispensing rates. The first valve 143 may include multiple orifice configurations that correspond to different rotational positions of the dial 141, with each orifice size calibrated to provide a specific flow rate of cleaning fluid. When the dial 141 is rotated to different positions, the first valve 143 may align different orifice sizes with the fluid flow path, allowing users to select from multiple predetermined flow rates based on cleaning requirements. The clean water and/or cleaning solution(s) from the fluid supply tank 106 may flow downward via gravity through the first valve 143 toward the base 104, with the flow rate determined by the selected orifice size and the gravitational pressure head provided by the fluid level in the tank 106.

The fluid dispensing system may incorporate a second valve 145 positioned downstream of the first valve 143 to provide user-activated control over fluid delivery timing. The second valve 145 may include a piston mechanism that remains in an extended position by default, blocking the flow of cleaning fluid through the second valve 145 and preventing continuous dispensing. When a trigger mechanism 138 on the handle 137 is activated by the user, the piston within the second valve 145 may retract to allow cleaning fluid to flow through the second valve 145 and continue toward the base 104 via supply lines 112. This dual-valve configuration may enable users to pre-select the desired flow rate using the mechanical dial 141 while maintaining precise control over when cleaning fluid is dispensed during cleaning operations.

Figure 2A:
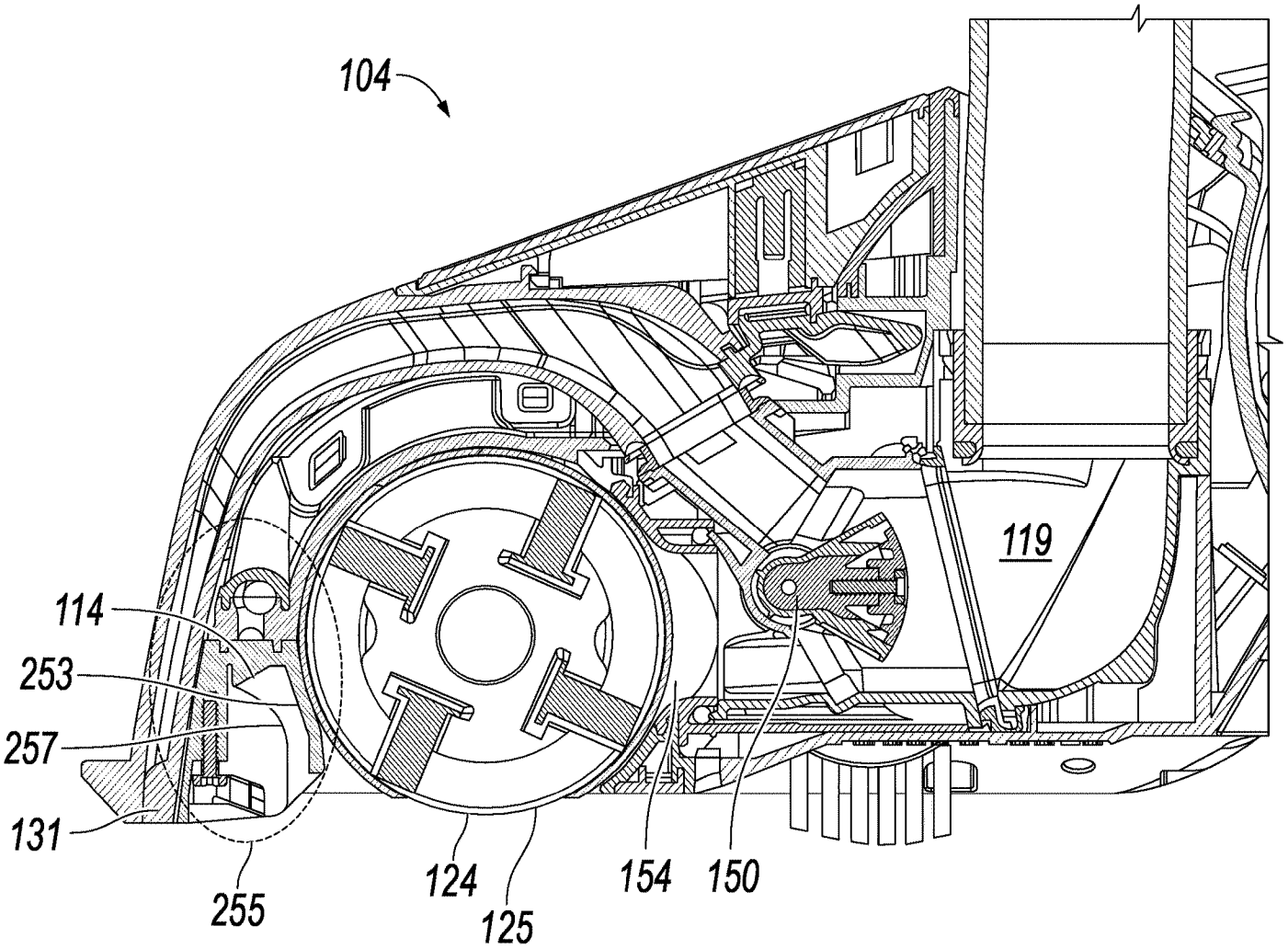
FIG. 2A is a side cross-sectional view of a waterfall manifold assembly in a cleaning head of the extraction cleaner of FIG. 1A.

Referring now to FIG. 2A, the extraction cleaner 100 can include one or more fluid distribution components. One example of a fluid distribution component is a manifold, which is an intermediate surface configured to deliver cleaning solution evenly across a surface to be cleaned and/or an agitator element. By using gravity and surface tension, the manifold can spread fluid in a controlled manner. For example, the extraction cleaner 100 can include a waterfall manifold 255. The waterfall manifold 255 may be positioned above and/or adjacent the agitator 124 within the base 104 to provide controlled fluid distribution during cleaning operations. The waterfall manifold 255 may be disposed within the agitator chamber 116 and may be configured to receive fluid from the fluid supply tank 106 through a fluid supply system that delivers cleaning solution to the cleaning components. The waterfall manifold 255 may comprise a manifold cover 253 having a plurality of spray nozzles 114 integrated therein, with the spray nozzles 114 configured to dispense fluid onto a curved surface 257 that extends below the manifold cover 253. In some embodiments, the manifold cover 253 is configured to block at least a portion of the debris from blocking, reaching, and/or otherwise interfering with the spray nozzles 114 while still allowing the spray nozzles 114 to dispense fluid. In some cases, the waterfall manifold 255 may be positioned at a top of the agitator chamber 116 to enable gravitational flow of dispensed fluid toward the agitator 124, allowing the fluid to cascade downward through the manifold assembly before reaching the surface being cleaned. In this configuration, the waterfall manifold 255 enables fluid dispensed onto the manifold cover 253 to cascade downward across the curved surface 257 before reaching the agitator 124, allowing for pre-wetting of the agitator 124. The fluid spreads laterally and longitudinally across the curved surface 257, promoting uniform coverage and reducing the likelihood of streaking and/or oversaturation.

The curved surface 257 may be configured to receive fluid from the fluid supply system and distribute the fluid across the agitator 124 via gravitational flow and surface tension effects. The curved surface 257 may extend longitudinally along a width of the agitator 124, providing a distribution pathway that spans substantially the entire working width of the agitator 124. In some embodiments, the waterfall manifold 255 may have a maximum width that corresponds to greater than or equal to 100% of a maximum width of the agitator 124, allowing for fluid to be distributed across the entire width of the agitator 124. In some embodiments, the outermost of the spray nozzles 114 are positioned inward of the outer edge of the agitator 124, but the curved surface 257 spreads the cleaning fluid and/or water distribution to be greater than or equal to the maximum width of the agitator 124. In some embodiments, the maximum width between the outermost of the spray nozzles 114 may be up to 99%, up to 95%, up to 90%, up to 85%, up to 80%, up to 75%, up to 70%, up to 65%, up to 60%, up to 55%, and/or up to 50% of the maximum width of the agitator 124. In some cases, the curved surface 257 may include one or more deflectors positioned beneath the spray nozzles 114 to promote lateral dispersion of the dispensed fluid across the curved surface 257. The deflectors may be configured as ridges or raised features that redirect fluid flow patterns, causing the dispensed cleaning solution to spread more evenly across the curved surface 257 rather than flowing in concentrated streams. The curved surface 257 may have a radius of curvature that facilitates controlled fluid flow while maintaining adequate coverage across the agitator width. In this configuration, the manifold cover 253 may function as a first wall of the cleaning head at which the spray nozzles 114 are disposed, while the curved surface 257 may function as a second wall of the cleaning head that is adjacent to the agitator and receives the dispensed fluid from the first wall. In some embodiments, the dispensed fluid flows downward via gravity from the first wall onto the second wall and onto the surface to be cleaned. In some embodiments, the dispensed fluid makes contact with the agitator 124 prior to reaching the surface to be cleaned, and in other embodiments, the dispensed fluid does not contact the agitator 124 prior to reaching the surface to be cleaned. In some embodiments, one or both of the first and second walls can extend all the way to the surface to be cleaned. For example, one or both of the curved surface 257 and the manifold cover 253 can extend to the ground, leaving no gap between the manifold 255 and the surface to be cleaned.

In some embodiments, the manifold cover 253 includes an angled face having a plurality of openings configured to receive spray nozzles 114. The angled face may be oriented forward at an angle of approximately 30 to 45 degrees relative to a horizontal axis. This forward orientation facilitates gravitational flow of fluid dispensed from the spray nozzles 114 onto the curved surface 257 positioned below the manifold cover 253. The angle between the manifold cover 253 and the curved surface 257 (e.g., between a first wall and a second wall of the cleaning head) may be selected to promote lateral dispersion of fluid across the width of the curved surface 257 prior to longitudinal flow along its length. In some embodiments, the initial contact region of the curved surface 257 may be approximately parallel to the surface to be cleaned. In some embodiments, an angle between the initial contact region of the curved surface 257 and the surface to be cleaned can range between about 0 to about 30 degrees. For example, the surface to be cleaned may be parallel to the horizontal axis, and the initial contact region of the curved surface 257 may be oriented about 25 degrees from the horizontal axis. In some embodiments, the curved surface 257 has a radius of curvature of approximately 20 mm. In some embodiments, a top portion of the curved surface 257 that first receives fluid from the spray nozzles 114 may be positioned adjacent to and/or in contact with a bottom portion of the manifold cover 253, forming a junction. In some embodiments, the junction is a sharp corner having a radius of curvature of less than 2 mm. Alternatively, a gap may be defined between the curved surface 257 and the manifold cover 253, with the gap measuring less than 2 mm.

The curved surface 257 may be constructed from a hydrophilic material to promote fluid adhesion and controlled flow along the curved surface 257 toward the agitator 124. The hydrophilic properties may cause the cleaning fluid to form a thin, uniform film across the curved surface 257 rather than beading or forming discrete droplets that could result in uneven distribution. The material selection for the curved surface 257 may also provide durability against chemical exposure from various cleaning agents while maintaining the desired surface energy properties for optimal fluid spreading.

The spray nozzles 114 integrated within the manifold cover 253 may be positioned at predetermined locations to allow fluid to flow across the curved surface 257. In some embodiments, the spray nozzles 114 may be configured to produce specific spray patterns that complement the deflector arrangement on the curved surface 257, creating a coordinated fluid distribution system. In some embodiments, the spray nozzles 114 may be oriented to direct fluid streams laterally across the curved surface 257 to achieve uniform distribution. The waterfall manifold 255 may enable the dispensed fluid to spread over the width of the curved surface 257 prior to contacting the surface being cleaned, allowing for pre-wetting of the agitator 124 and enhanced cleaning solution delivery to the surface.

The waterfall manifold 255 includes various fluid delivery features to deliver water or other cleaning fluid to the spray nozzles 114. To maximize fluid coverage over an agitator (e.g., agitator 124), fluid distribution manifolds often include several fluid outlets spaced laterally apart to ensure each fluid outlet can emit fluid onto a corresponding portion of the agitator. When fluid is supplied to the manifold, it may have a difficult time flowing to every fluid outlet. Air can become trapped within the manifold, preventing fluid from fully filling its interior and evenly wetting the surface of the agitator. Fluid manifolds are often relied on because of their increased fluid efficiency-less fluid is required for a given cleaning operation when using a manifold versus one or more spray nozzles. The presence of trapped air undermines the manifold's ability to evenly coat an agitator. Attempts to remove this air are often unsuccessful Increasing the pressure of fluid supplied to the manifold in an attempt to somehow flush the trapped air will likely backfire. Supplying fluid at an increased pressure to the manifold will likely not remove the trapped air, and it may cause additional fluid to be emitted by the outlets of the manifold which remain unobstructed by the trapped air. This can cause the emitted fluid to spray out, rather than drip or flow out, which undermines the increased fluid efficiency of the manifold in the first place, all while the trapped air remains trapped.

Figure 2B:
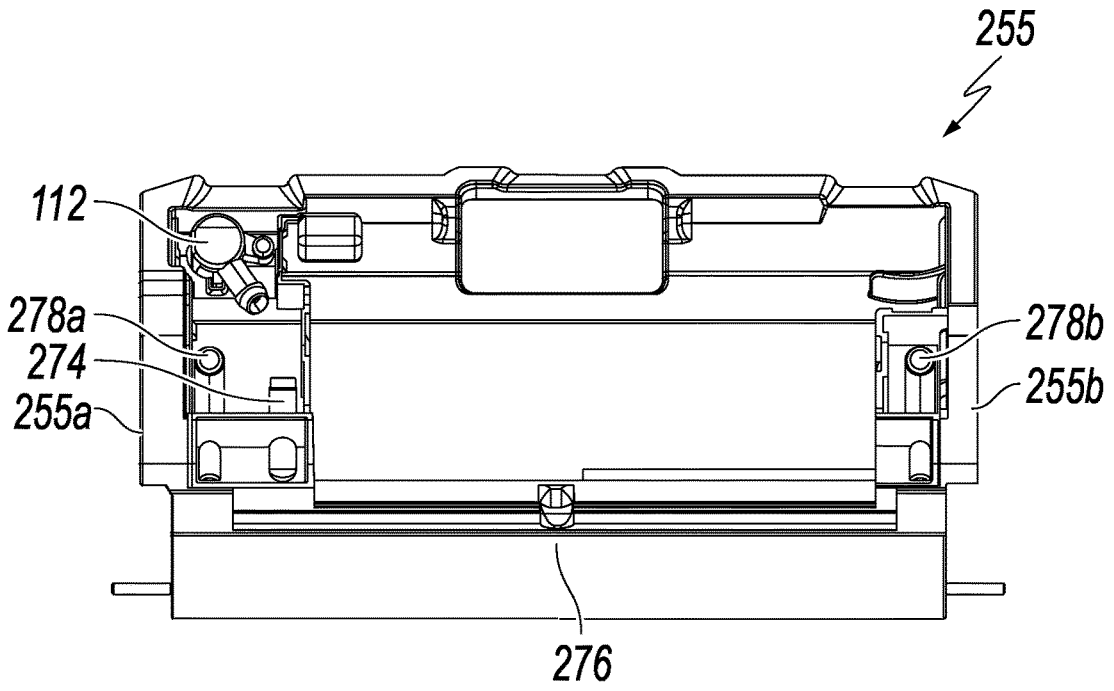
FIG. 2B is a front view of the waterfall manifold assembly of FIG. 2A.
Figure 2C:
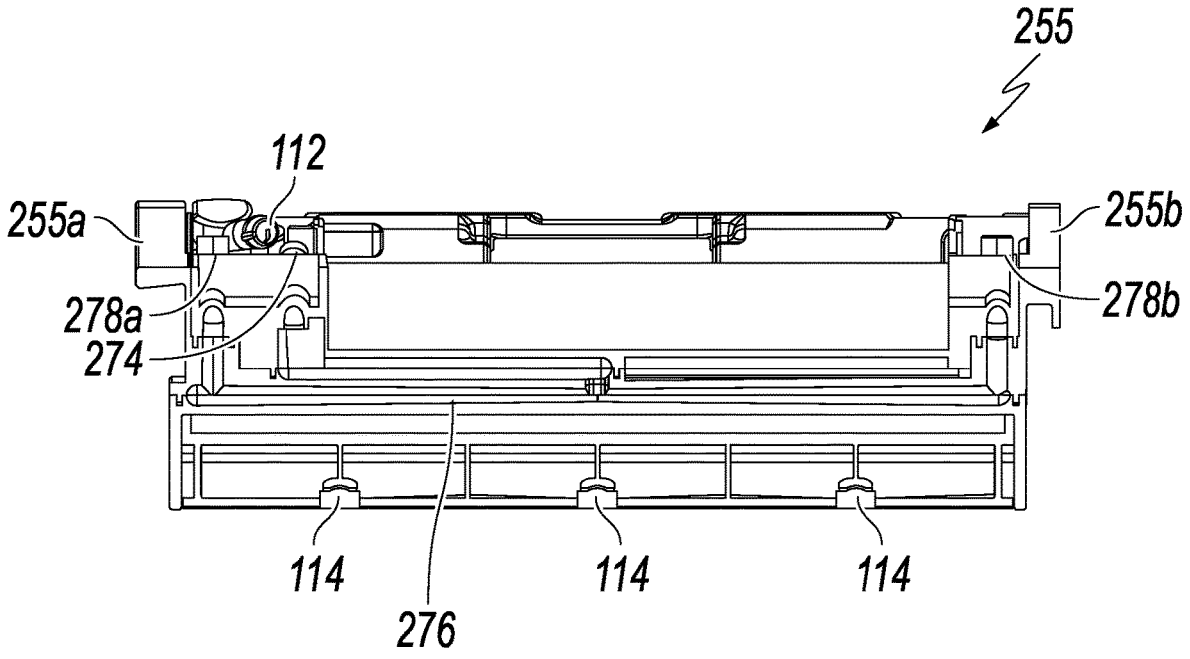
FIG. 2C is a bottom view of the waterfall manifold assembly of FIG. 2A.
Figure 2D:
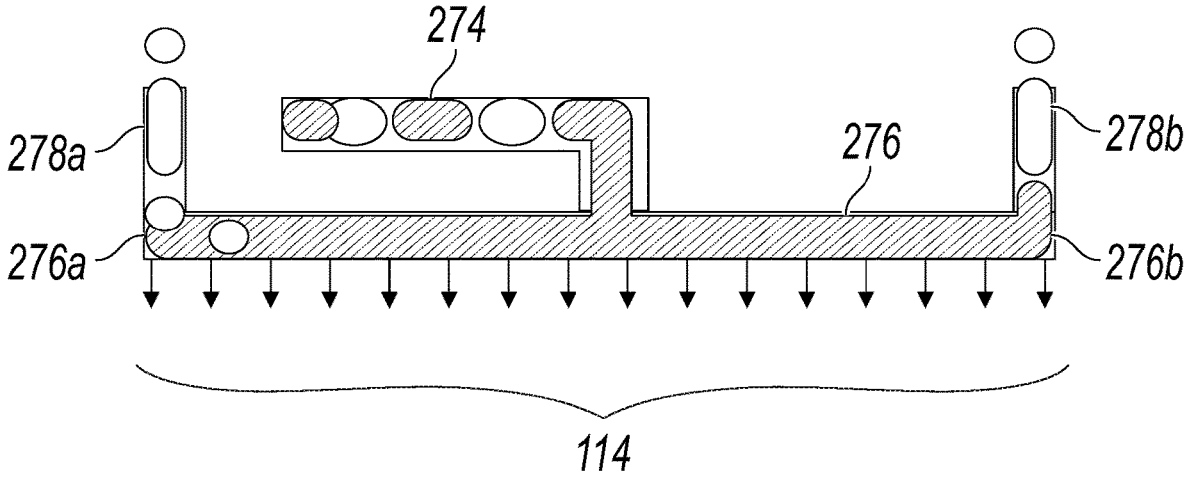
FIG. 2D is a cross-sectional schematic of the waterfall manifold assembly of FIG. 2A.

The manifold 255 includes features to bleed off trapped air while ensuring proper fluid supply to outlets of the manifold 255. As shown in FIGS. 2B-2D, the waterfall manifold 255 includes a manifold inlet 274, which can be a barb configured to fluidly connect the waterfall manifold 255 to one or more of the fluid supply lines 112. The manifold inlet 274 is, in turn, fluidly coupled to a channel 276 running along the width of the waterfall manifold 255. The channel 276 is configured to deliver fluid to the spray nozzles 114 disposed at various locations along the width of the manifold cover 253.

The waterfall manifold 255 can include standpipes 278*a*, 278*b* configured to assist in the even dispersion of fluid across the curved surface 257. As fluid flows through the channel 276, air bubbles that remain trapped in the channel 276 may disrupt the even distribution of fluid to the spray nozzles 114. The standpipes 278*a*, 278*b* are hollow open tubes extending generally upward that allow for the air bubbles to escape, without allowing for the cleaning fluid to exit the channel 276. Any cleaning fluid that does manage to escape the channel 276 is minimal in quantity and can drain around the sides of the base 104 without interfering with the operation of the extraction cleaner 100. To allow air bubbles to rise from the channel 276, the standpipes 278*a*, 278*b* can extend outward and upward from the channel 276 and vent the air away from the fluid, ensuring a smooth flow of fluid through the channel 276. As air enters the channel 276, trapped air is pushed laterally toward the standpipes 278*a*, 278*b* by following fluid. Fluid is then able to reach the spray nozzles 114 while the air is pushed through the standpipes 278*a*, 278*b*. The length of the standpipes can be proportional to an operating pressure of the fluid within the fluid lines of the extraction cleaner 100. Depending on the operating pressure of the extraction cleaner 100, the length of the standpipes 278*a*, 278*b* can be adjusted to ensure no fluid within the channel 276 is able to bubble upward and escape out of the standpipes 278*a*, 278*b*. As the internal operating pressure of the extraction cleaner 100 increases, the standpipes 278*a*, 278*b* must be longer so that this operating pressure is not sufficient to overcome the force of gravity and rate of emission via the nozzles 114 and push the fluid out of the standpipes 278*a*, 278*b*. In some embodiments, the standpipes 278*a*, 278*b* extend at least 20 mm, at least 25 mm, at least 30 mm, at least 35 mm, at least 40 mm, and/or at least 45 mm as measured from the center of the channel 276.

Aspects of the standpipes 278*a*, 278*b* can vary, depending on specific designs of the extraction cleaner 100. For example, the standpipes 278*a*, 278*b* can be disposed at opposite ends of the manifold 255. As shown in FIGS. 2B-2C, the first standpipe 278*a* can be disposed at a first end 255*a* of the manifold 255, and the second standpipe 278*b* can be disposed at a second end 255*b* of the manifold 255. In some embodiments, the standpipes 278*a*, 278*b* can be disposed at opposite ends of the channel 276 such that the channel 276 fluidly connects the standpipes 278*a*, 278*b* with one another. As shown in FIG. 2D, the first standpipe 278*a* can be in fluid communication with a first end 276*a* of the channel 276, and the second standpipe 278*b* can be in fluid communication with a second end 276*b* of the channel 276. In some embodiments, the inlet 274 can be disposed at any position between the first end 276*a* and the second end 276*b* of the channel 276, such as at a middle position approximately equidistant from the first end 276*a* and the second end 276*b*.

In some embodiments, one or both of the standpipes 278*a*, 278*b* can extend at an angle from the rest of the channel 276. This angle can be the same for the first standpipe 278*a* and the second standpipe 278*b* or can vary between the standpipes 278*a*, 278*b*, in order to, for example, accommodate other architecture of the extraction cleaner 100. In some embodiments, the standpipes 278*a*, 278*b* can extend at an angle of between about 20 to 160 degrees as measured from a central axis extending longitudinally along the channel 276. For example, one or both of the standpipes 278*a*, 278*b* can extend at an angle of about 90 degrees from the channel 276 so as to be perpendicular to the rest of the channel 276. In some embodiments, the standpipes 278*a*, 278*b* extend from a top surface of the channel 276. In some embodiments, such as shown in FIG. 2B, one or both of the standpipes 278*a*, 278*b* can be curved. The standpipes 278*a*, 278*b* can have a degree of curvature of about 90 degrees. While two standpipes 278*a*, 278*b* are depicted, variations are contemplated which include only one standpipe or more than two standpipes.

Figure 3:
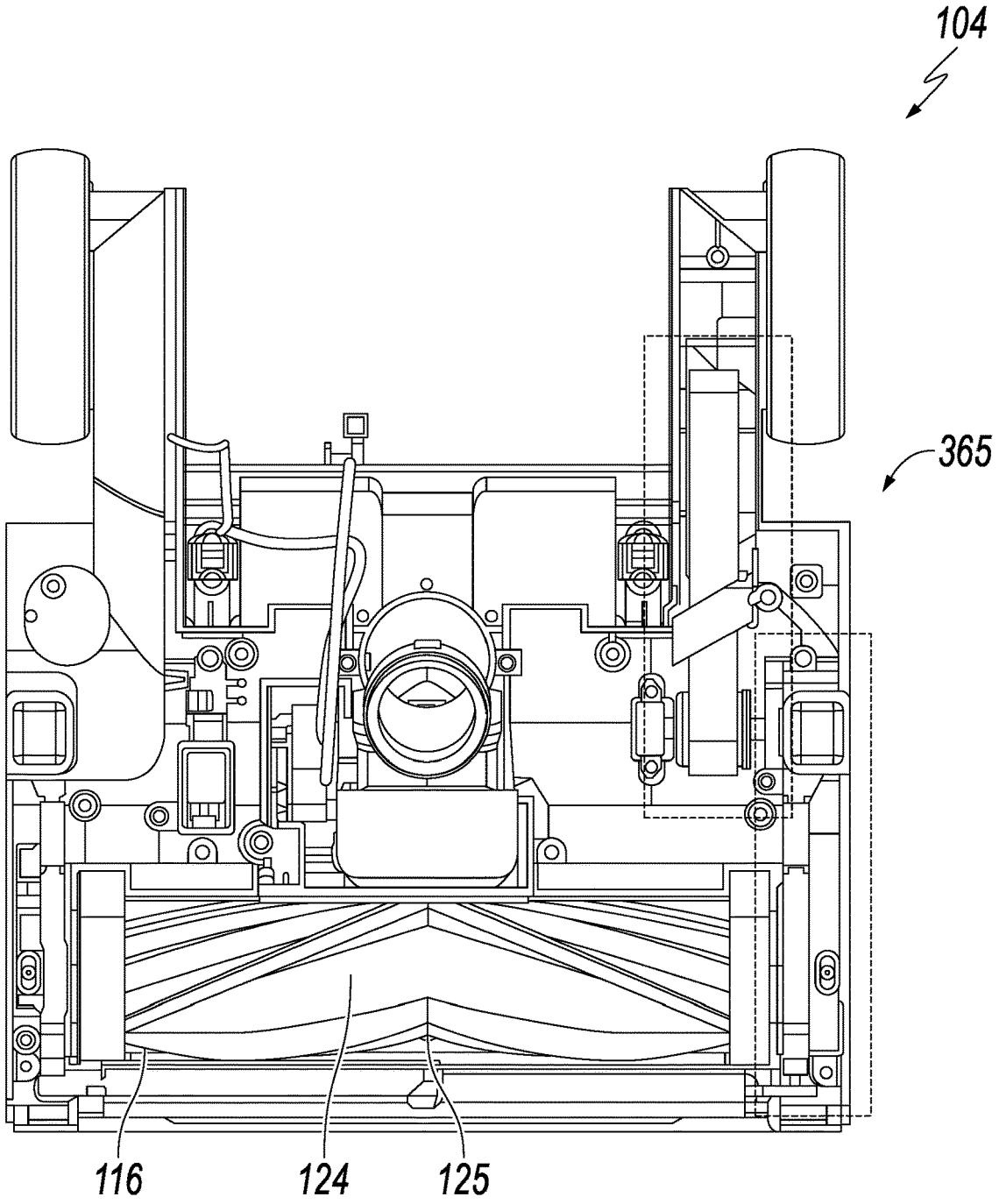
FIG. 3 is a top cross-sectional view of the cleaning head of the extraction cleaner of FIG. 1A with a dual-belt driving arrangement.

As described previously, in some embodiments, the extraction cleaner 100 may include mechanical components that drive cleaning elements such as agitators to enhance surface treatment. These mechanical components—such as motors, belts, and linkages—are used to transmit power within spatially constrained cleaning heads. Referring now to FIG. 3, an example motor and belt assembly of the extraction cleaner 100 is used to route mechanical power from a motor to drive cleaning components such as the agitator 124. For example, the base 104 may incorporate a dual belt assembly 365 that enables efficient power transmission to the agitator 124 despite spatial constraints within the cleaning head assembly. The dual belt assembly 365 may comprise a first belt and a second belt that work in coordination to transmit rotational motion from a motor to the agitator 124, with each belt configured to address specific mechanical requirements of the drive system. In some embodiments, the first belt may be a flat belt that provides smooth power transmission characteristics, while the second belt may be a toothed belt that offers positive engagement and precise timing control. In some embodiments, the two belts may be positioned off-center on one side of the base 104.

The motor may be positioned such that the motor is not directly aligned with the longitudinal axis of the agitator 124, creating a spatial offset between the motor and the agitator 124. This misalignment may result from packaging constraints within the base 104, where the motor placement may be optimized for weight distribution, accessibility, or integration with other components rather than direct axial alignment with the agitator 124. The belt assembly 365 may enable transmission of rotational motion from the motor to the agitator 124 despite the motor and agitator 124 being positioned in different orientations within the cleaning head 104, allowing for flexible component placement while maintaining effective power transfer. In some embodiments, the dual belt assembly 365 may provide redundancy in the drive system, where the first belt and second belt may share the load requirements and/or provide continued operation even if one belt experiences temporary slippage. The dual belt assembly 365 may also incorporate intermediate pulleys or tensioning mechanisms within the base 104 that maintain proper belt tension and alignment throughout the drive path. Thus, the dual belt assembly 365 may enable the motor to be positioned in locations that optimize the overall balance and center of gravity of the extraction cleaner 100 while still providing effective drive capability for the agitator 124.

As described previously, in some embodiments, the extraction cleaner 100 may include a diverter valve 150 positioned within the base 104 and configured to selectively control suction airflow between multiple suction inlets. Over time, the diverter valve 150 may accumulate debris, including hair, dust, and sticky substances, which can obstruct airflow and reduce cleaning performance. Because the diverter valve 150 is located within the internal housing of the base 104, accessing it for maintenance can be difficult without disassembling other components of the cleaning device.

Figure 4A:
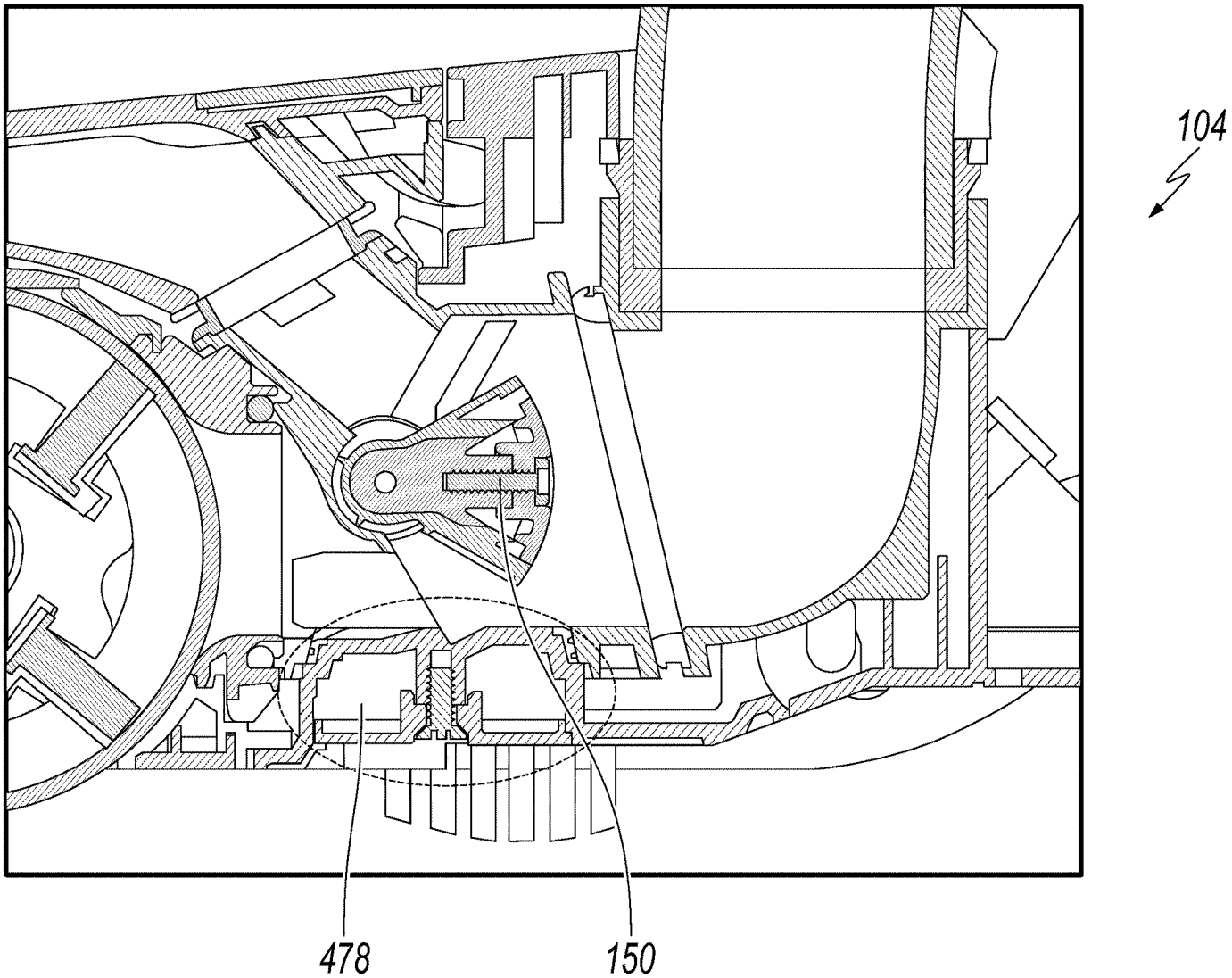
FIG. 4A is a side cross-sectional view of the extraction cleaner of FIG. 1A and depicting a hatch for access to a diverter valve.
Figure 4B:
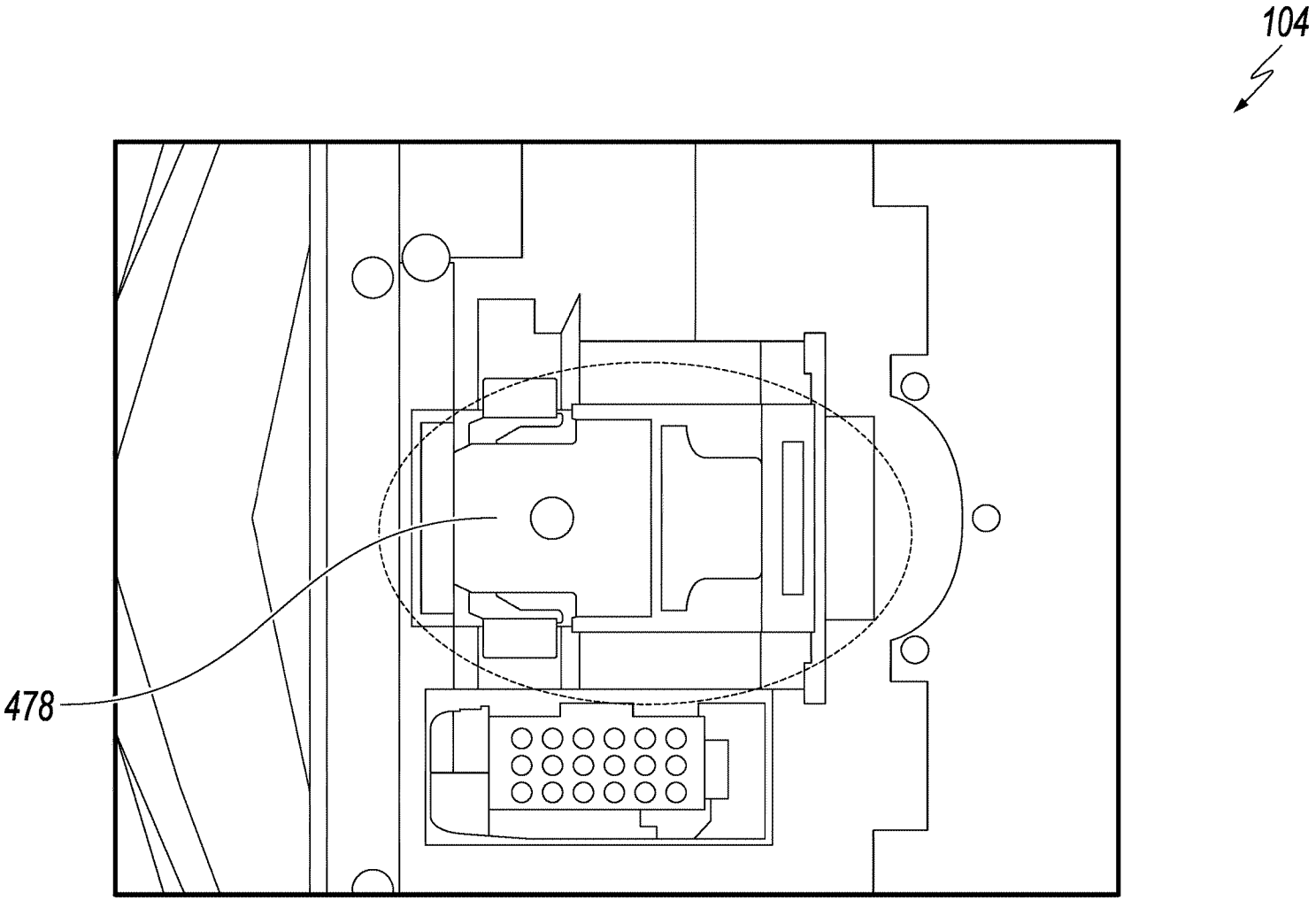
FIG. 4B is a bottom view of the extraction cleaner of FIG. 1A and the hatch of FIG. 4A.

To address this issue, the extraction cleaner 100 can include a removable access hatch 478 positioned on the base 104. Referring now to FIGS. 4A and 4B, the removable access hatch 478 may be positioned on a side and/or bottom surface of the base 104, allowing users to access the diverter valve 150 by inverting or tilting the extraction cleaner 100 during service procedures. In some embodiments, the access hatch 478 forms at least a portion of a sealing face for the diverter valve 150 (e.g., a bottom surface of the diverter valve). For example, when the access hatch 478 is installed, fluid flow is contained within the diverter valve 150, and when the access hatch 478 is removed, fluid flow that would otherwise pass through the diverter valve 150 can escape through the access hatch 478. The access hatch 478 may be hinged on one side and may have a snap fitting on another side, with seals around the perimeter of the access hatch 478 to prevent leaks. In some cases, the removable access hatch 478 may be secured using one or more fasteners that allow for easy removal and reattachment of the access hatch 478, enabling users to perform maintenance tasks without requiring specialized tools or extensive disassembly of other components. The fasteners may include thumb screws, quarter-turn fasteners, and/or snap-fit mechanisms that provide secure retention during normal operation while allowing rapid removal when access to the diverter valve 150 becomes necessary.

The positioning of the removable access hatch 478 may correspond to the location of the airflow path 119 within the base 104, creating a direct pathway to the diverter valve 150 without interference from other components such as the agitator 124 or surrounding structural elements. The access hatch 478 may be sized to provide adequate clearance for maintenance tools and user access while maintaining the structural integrity of the base 104 during cleaning operations. In some embodiments, the access hatch 478 may include sealing features such as gaskets or O-rings that prevent debris infiltration into the airflow path 119 when the access hatch 478 remains closed during normal use. The sealing features may maintain the enclosed nature of the airflow path 119 while allowing the access hatch 478 to be opened when maintenance access becomes necessary.

Figure 5A:
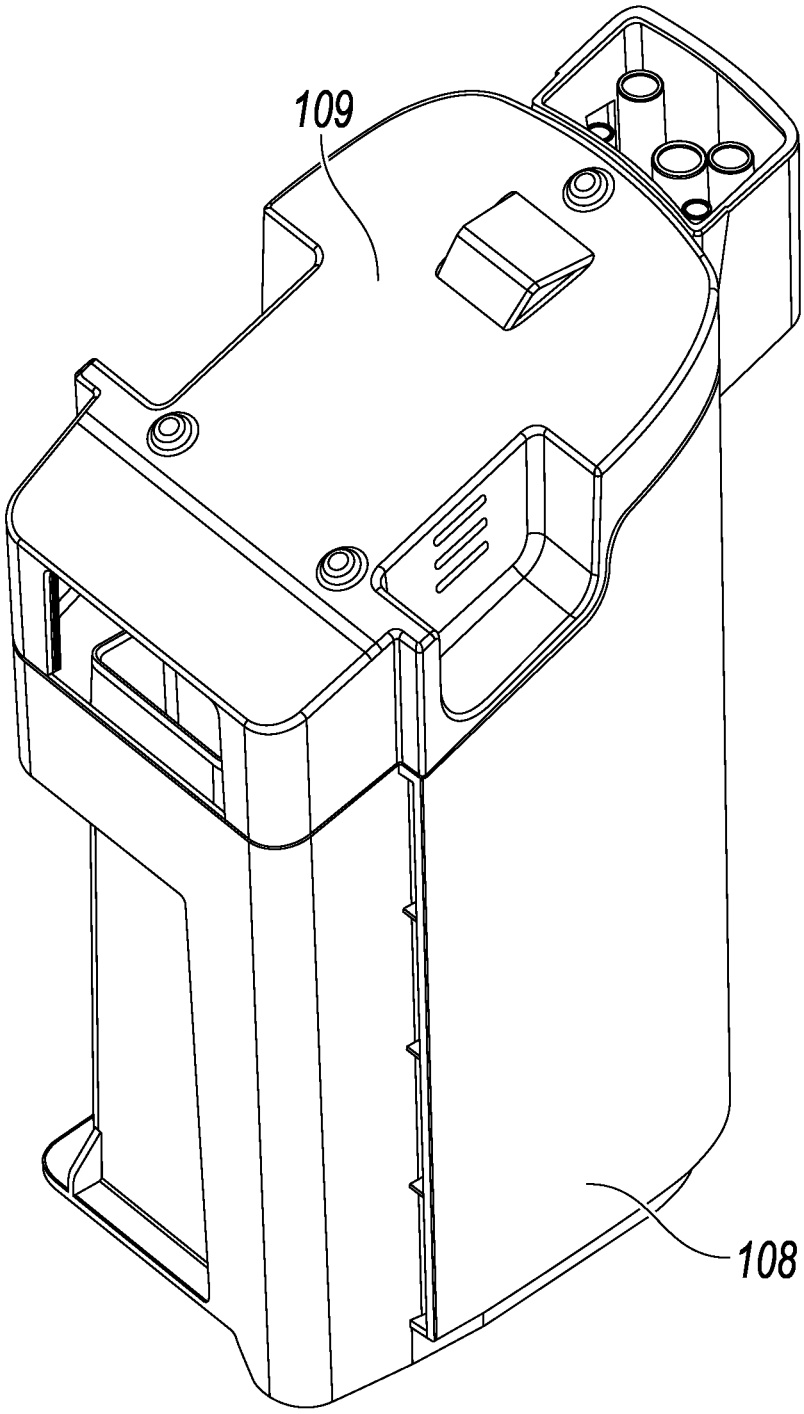
FIG. 5A is a perspective view of a recovery tank of the extraction cleaner of FIG. 1A.
Figure 5B:
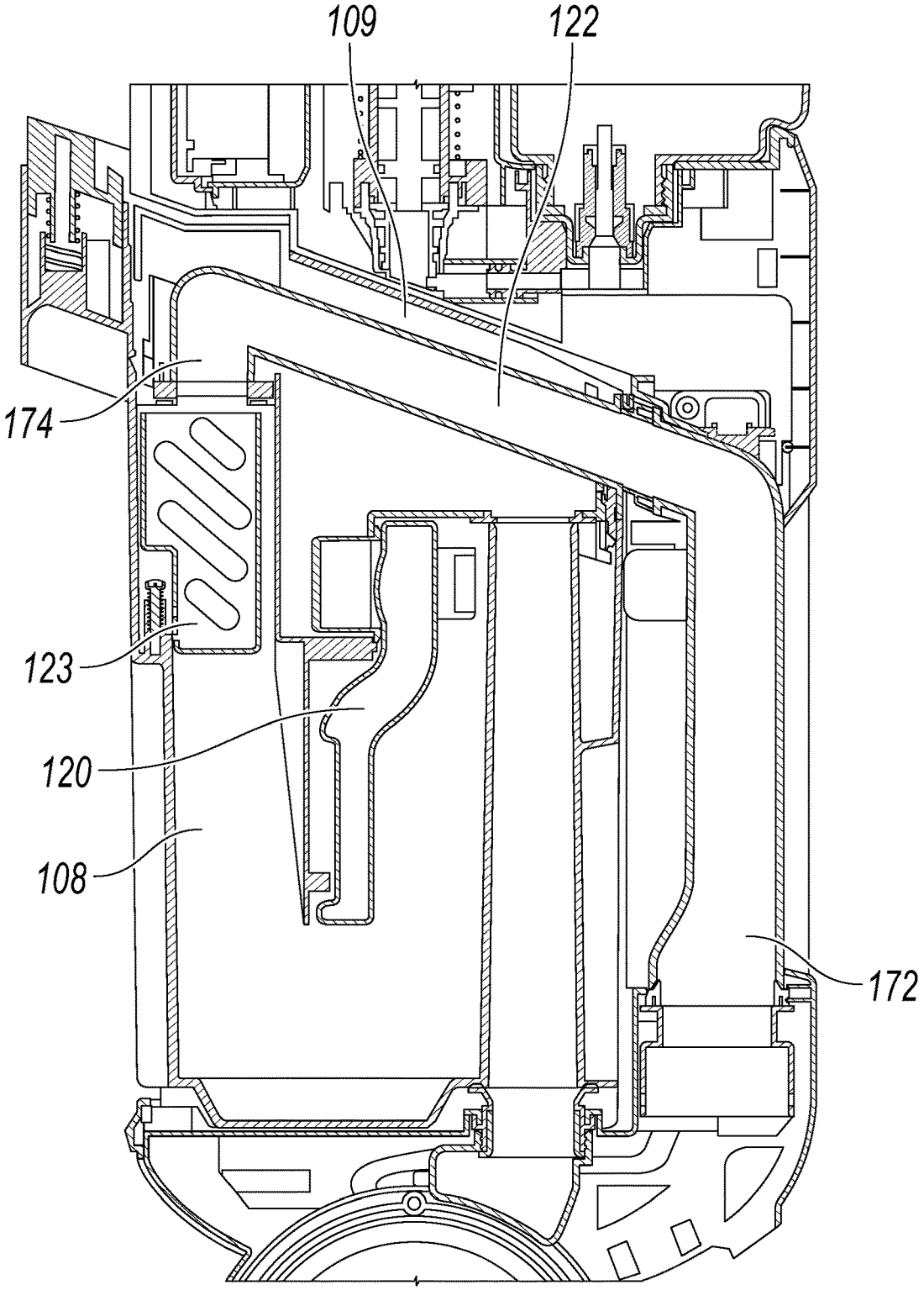
FIG. 5B is a side cross-sectional view of the recovery tank of FIG. 5A.

As described previously, in some embodiments, the extraction cleaner 100 may include a recovery tank 108 that collects fluid and debris removed from the surface during cleaning operations. The recovery tank 108 plays a role in maintaining hygiene and operational efficiency by securely storing waste materials until disposal. Referring now to FIGS. 5A-5F, the recovery tank 108 of the extraction cleaner 100 is depicted in greater detail, illustrating how fluid pathways, ducting, and separation features are integrated to manage the intake and containment of debris-laden fluid. For example, the recovery tank 108 may be configured as a removable fluid collection system that receives and retains drawn-in fluid and debris from the cleaning operations. As shown in FIGS. 5A-5B, the recovery tank 108 may comprise a body that defines a hollow interior and an opening leading to the hollow interior, with the hollow interior being configured to receive and retain fluid and debris collected during cleaning cycles. In some embodiments, the recovery tank 108 may be removably coupled to the upright body 102 through mounting mechanisms that allow users to detach the tank for emptying and cleaning operations. The recovery tank 108 may be configured to couple to the upright body 102 such that fluid pathways in the lid 109 of the recovery tank 108 align with the airflow path 119 of the extraction cleaner 100, enabling the uninterrupted flow of collected materials from the base 104 to the recovery tank 108.

Figure 5C:
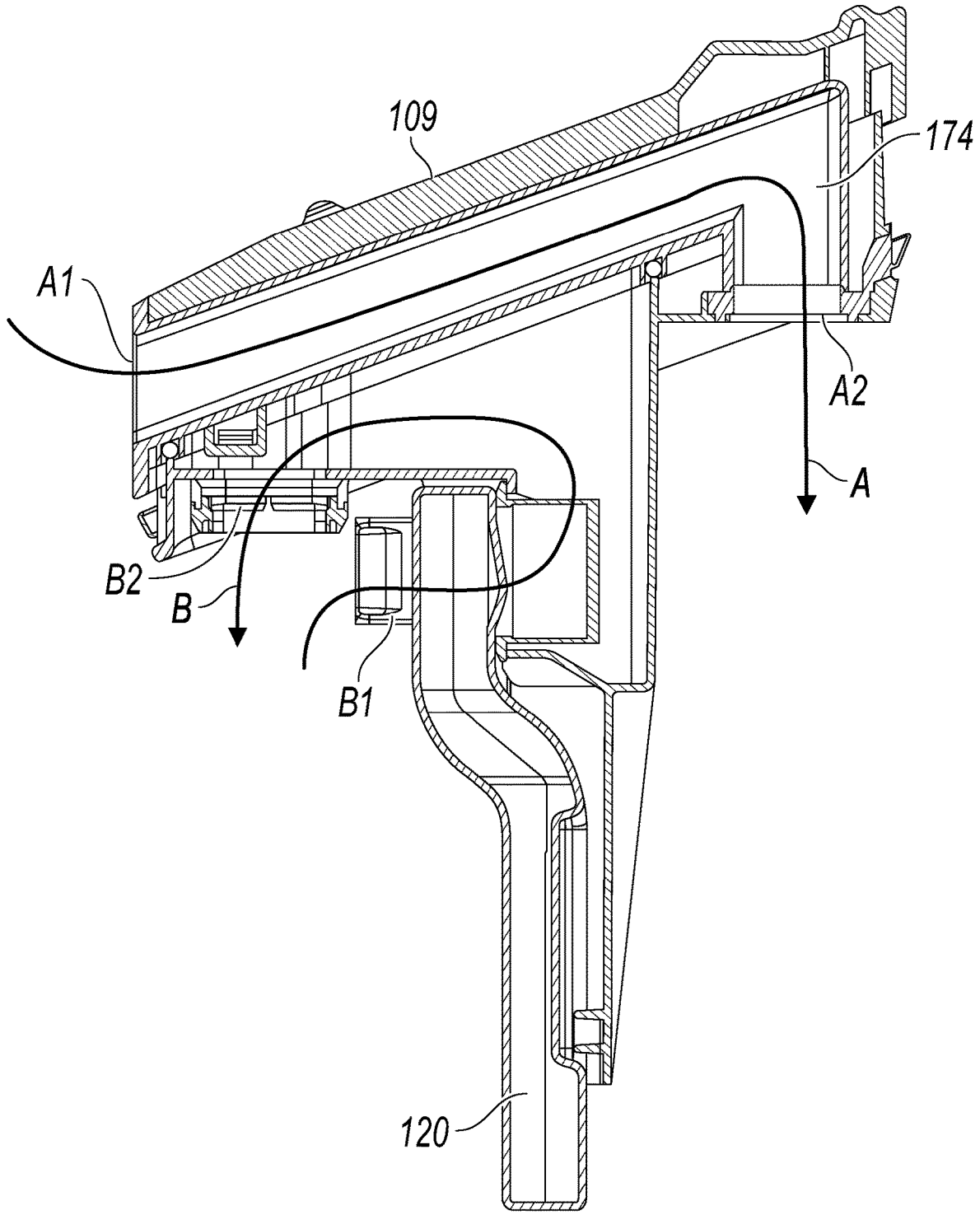
FIG. 5C is a side cross-sectional view of a lid of the recovery tank of FIG. 5A.

As shown in FIG. 5C, the lid 109 may be configured to removably cover the opening leading to the hollow interior of the recovery tank 108. The lid 109 may define a first lid flow path A therethrough that remains in fluid communication with and upstream of the hollow interior when the lid 109 remains disposed in the opening of the recovery tank 108. The first lid flow path A may extend from a first end A1 positioned at a front portion of the lid 109 to a second end A2 positioned at a rear portion of the lid 109, creating a defined pathway for fluid, debris, and/or air movement through the lid 109 and into the recovery tank 108. For example, fluid, debris, and/or air may enter the lid 109 from the first end A1 via the upduct 172 and exit the lid 109 from the second end A2 into the recovery tank 108. The lid 109 may also define a second lid flow path B therethrough that remains in fluid communication with and downstream of the hollow interior. The first end B1 of the second lid flow path B may fluidly connect the lid 104 to a top region of the hollow interior containing air. The second end B2 of the second lid flow path B may fluidly connect to the suction motor 118 when the lid 109 is disposed in the recovery tank 108. Air can leave the recovery tank 108 to enter the lid 109 from the first end B1 and exit the lid 109 from the second end B2 toward the suction motor 118. In some embodiments, the float valve 120 is configured to selectively block the second lid flow path B depending on the fluid level within the recovery tank 108. If the fluid level is above a certain level, the float valve 120 floats upward until it blocks at least a portion of the second lid flow path B (e.g., a portion near the first end B1), which creates noise by reducing air flow to the suction motor 118.

In some embodiments, air that exits the lid 109 (e.g., via the second lid flow path B) can then proceed toward an exhaust duct that fluidly connects the lid 109 to the suction motor 118. In some embodiments, the exhaust duct is a standalone duct that is separate from the interior of the recovery tank 108. The exhaust duct can be arranged on an opposite side of the recovery tank 108 as the upduct 172. The exhaust duct can transport air to the suction motor 118 without transporting debris and/or liquid, which remain inside of the recovery tank 108. In some embodiments, the exhaust duct can be partially and/or fully closed and/or sealed in order to restrict the suction capabilities of the extraction cleaner 100.

Referring back to FIG. 5B, in some embodiments, the lid 109 may be fluidly coupled to the upduct 172 of the cleaning device when the recovery tank 108 is coupled to the upright body 102. In some embodiments, the lid 109 may include a coupling mechanism that may be configured to removably connect the lid 109 to the upduct 172, with the coupling mechanism providing a sealed fluid connection between the upduct 172 and the first end of the first lid flow path to prevent air leakage and maintain suction efficiency. Although the upduct 172 may be illustrated as being positioned at a front portion of the body in some configurations, the upduct 172 may be positioned in various locations such as the side, rear, top, or bottom of the extraction cleaner 100.

The upduct 172 may feature a curved or angled configuration that extends upward from the base 104 and then angles backward toward the recovery tank 108, creating a fluid passage that accommodates the spatial arrangement of components within the extraction cleaner 100. In some embodiments, the upduct 172 may have a bend that extends upward from the suction inlet and then angles backward above the recovery tank 108, allowing the upduct 172 to bridge the distance between the base-mounted suction components and the recovery tank 108 positioned on the upright body 102. In some embodiments, the top portion of the upduct 172 may include a roughly 90-degree curve or bend, which may distinguish it from other upducts that do not incorporate such a bend configuration. The curved geometry of the upduct 172 may facilitate smooth fluid flow transitions while minimizing pressure losses that could reduce suction efficiency, with the bend radius selected to prevent debris accumulation at flow direction changes. For example, the bend radius of an inside wall of the upduct 172 (e.g., a wall with the smallest bend radius) can be 20 mm. In some embodiments, the upduct 172 is curved such that fluid/debris enters an inlet of the upduct 172 and exit an outlet of the upduct 172 in different directions.

In some embodiments, the upduct 172 may be positioned to be visible when viewed from the outside of the body 102, allowing a user to view the upduct 172 without removing it from the body 102. The upduct 172 may have a cross-sectional area that changes in both size and shape along its length, which may help maintain optimal suction performance while enabling connection to two differently-shaped components within the fluid pathway. In some embodiments, the cross-sectional area of a lower end of the upduct 172 that connects to the base 104 can be greater than or equal to twice the cross-sectional area of an upper end of the upduct 172 that connects to the recovery tank 108. For example, the cross-sectional area of the lower end can be 1670 mm, and the cross-sectional area of the upper end can be 750 mm. In some embodiments, the upduct 172 can step down and/or taper down from the larger cross-sectional area to the larger cross-sectional area at any point along the length of the upduct 172.

Figure 5D:
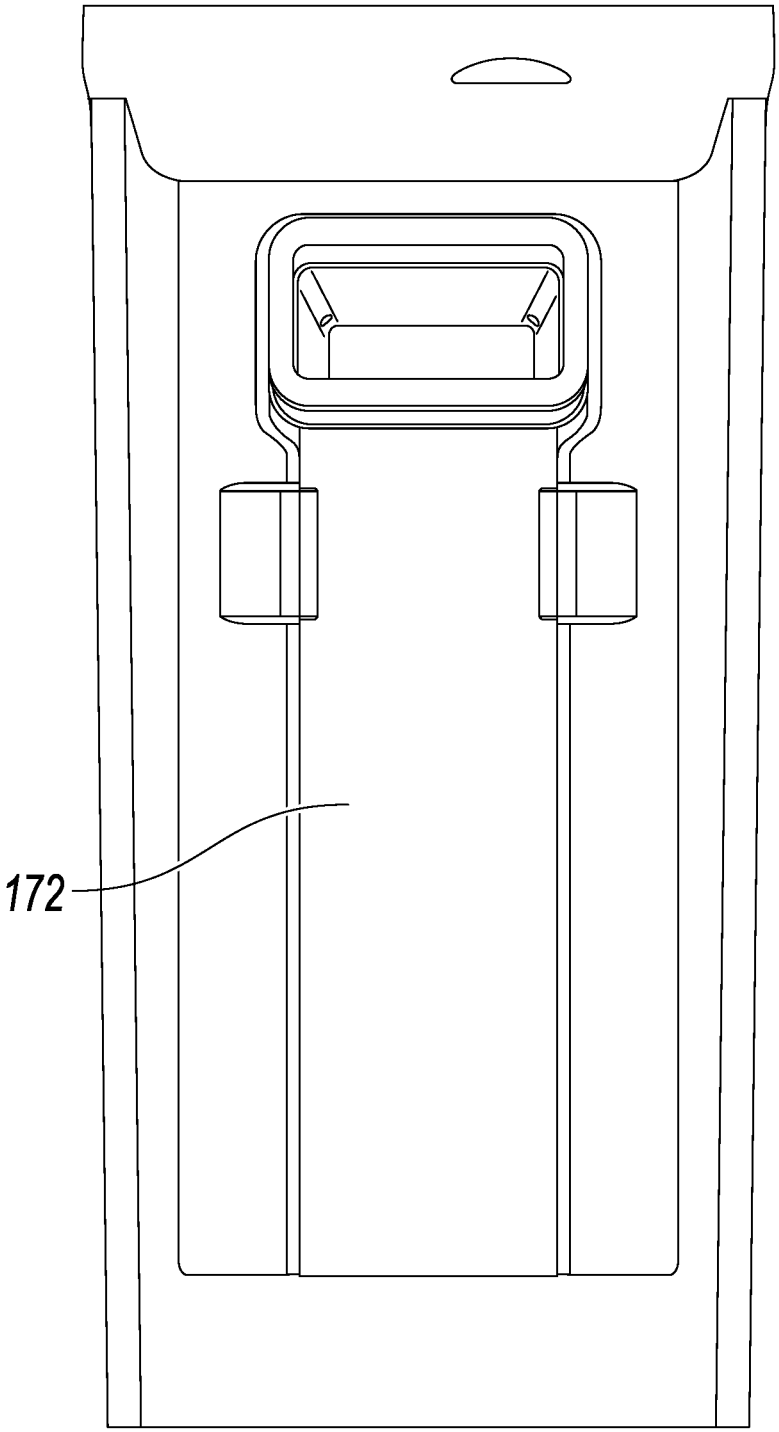
FIG. 5D is a rear cross-sectional view of an upduct of the extraction cleaner of FIG. 1A, the upduct being connectable to the recovery tank of FIG. 5A.

Referring now to FIG. 5D, the upduct 172 may be removably mountable to the body 102 and/or the recovery tank 108, enabling users to detach the upduct 172 for cleaning and maintenance operations while maintaining the structural integrity of the fluid pathway during normal use. In some embodiments, when the recovery tank 108 and the upduct 172 are both mounted to the body 102, the upduct 172 is disposed between the recovery tank 108 and a front portion of the body 102. In some embodiments, when the recovery tank 108 and the upduct 172 are both mounted to the body 102, a seal surrounding a perimeter of the upduct 172 can be positioned against an inlet of the recovery tank 108 (e.g., an opening within the lid 109). To remove the upduct 172 from within the body 102, the recovery tank 108 can be removed first to then allow access to the upduct 172 for removal. In some embodiments, the body 102 can include an opening and/or hatch that allows at least a portion of the upduct 172 to be viewed from outside of the body 102 without needing to first remove the upduct 172 from the body.

Figure 5E:
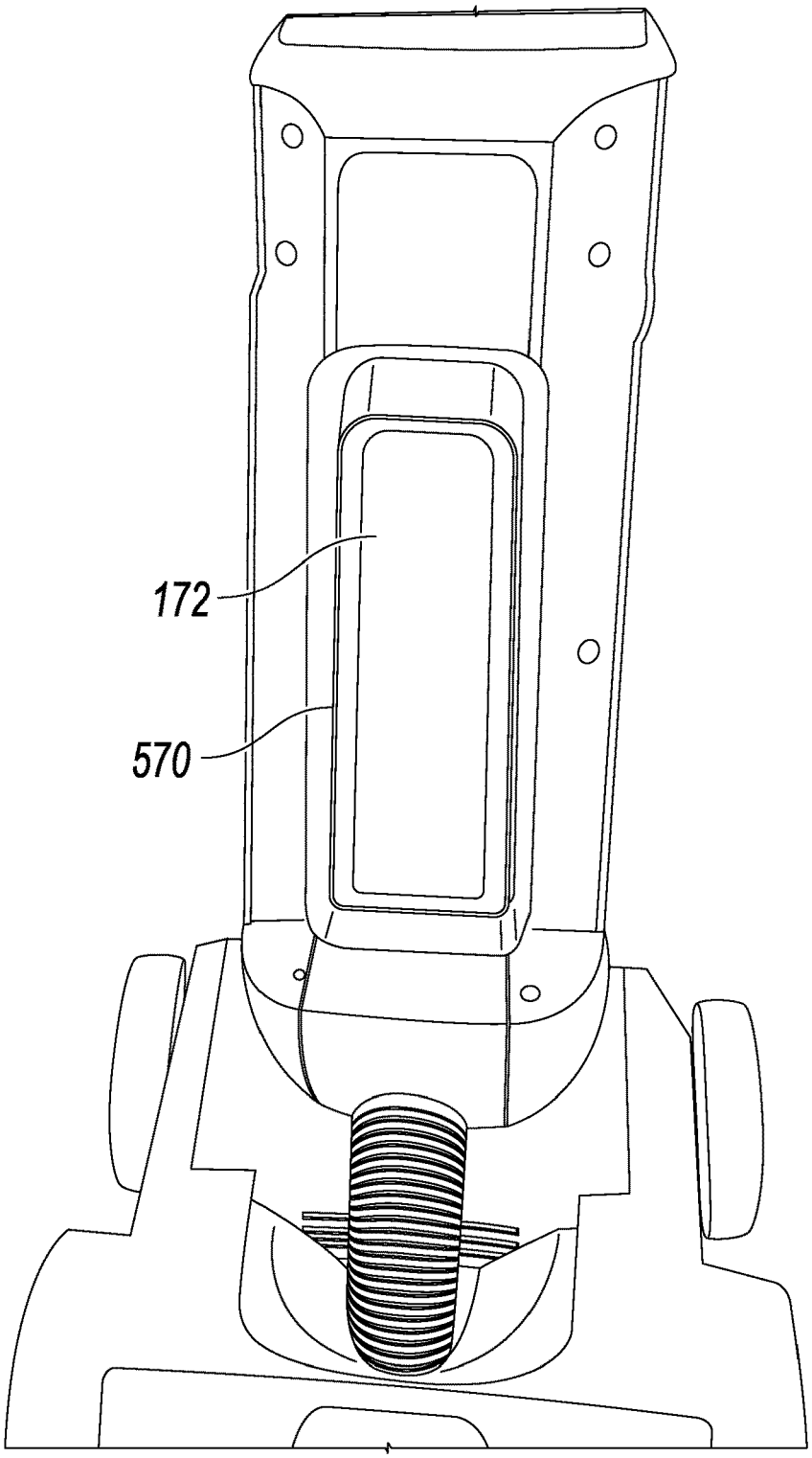
FIG. 5E is a front view of the upduct of FIG. 5D.

As shown in FIG. 5E, the upduct 172 may include lighting 570 along the length to illuminate an interior of the upduct 172 for visual detection of obstructions that could impede fluid flow and/or reduce cleaning performance. The lighting 570 may comprise LED lights positioned along the length of the upduct 172, providing illumination that enables users to inspect the internal passages for debris buildup or blockages In some embodiments, the LED lights may be red, green, blue, and/or white LED lights that may provide high contrast against shadows cast by obstructions within the upduct 172, enhancing the visibility of potential flow restrictions. The LED lights can be activated individually or in combination to produce light of any visible wavelength. The LED lights can be positioned in the body 102 around one, two, three, or more sides of the upduct 172 when installed in the body 102. In some embodiments, the lighting 570 may be integrated within the upduct 172, allowing the upduct 172 to be removably coupled to the recovery tank 108 while maintaining the lighting capability for inspection purposes. The lighting 570 may be powered through electrical connections that engage when the upduct 172 becomes mounted to the extraction cleaner 100. In some embodiments, the lighting 570 may be installed in the upright body 102 adjacent the upduct 172, such that removing the upduct 172 does not remove the lighting 570. The lighting 570 may be powered through electrical connections within the upright body 102.

Figure 5F:
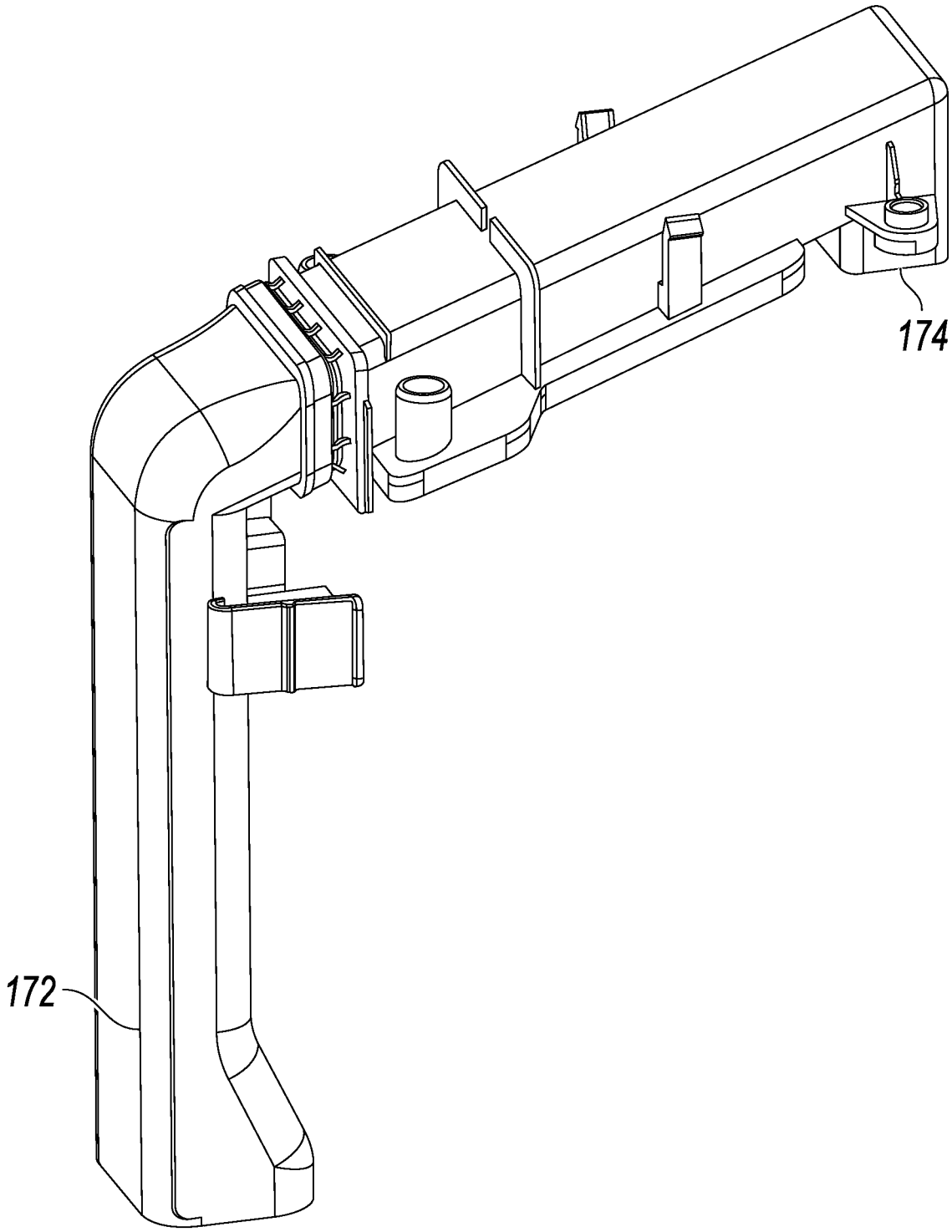
FIG. 5F is a perspective view of the upduct of FIG. 5D and a down duct of the extraction cleaner of FIG. 1A, the upduct and down duct being connectable to one another.

As shown in FIGS. 5A-5B and 5F, a down duct 174 may be fluidly connected to the second end of the lid pathway and may extend downward into the tank interior of the recovery tank 108, directing the incoming fluid and debris toward the storage volume. The down duct 174 may be positioned at a rear portion of the tank interior and may extend vertically downward from the lid, creating a delivery pathway that guides collected materials into the hollow interior without interfering with other tank components. In some embodiments, the down duct 174 may extend to a predetermined depth within the recovery tank 108 to ensure proper fluid delivery while maintaining clearance for other internal mechanisms such as debris separation components. The positioning of the down duct 174 at the rear portion of the tank interior may improve the flow pattern within the recovery tank 108 by allowing collected fluids to settle toward the front of the tank while maintaining clear pathways for continued debris delivery.

The upduct 172 extends upward along the front of the recovery tank 108, then angles upward and backward above the top of the recovery tank 108 before transitioning into the down duct 174 at the rear of the recovery tank 108. This angled configuration promotes gravitational separation of liquid and solid materials during transport. As the mixture of liquid and solid debris travels through the upduct 172 across the top of the recovery tank 108, liquids can drip downward through a porous bottom wall of the upduct 172, falling into the recovery tank 108, while debris continues along the airflow path toward a downstream debris collection chamber 123 for solid debris.

The debris separator 122 may be disposed within the recovery tank 108 and may be configured to separate solid debris from liquid within the recovery tank 108 as collected materials flow through the system. In some embodiments, the debris separator 122 may comprise a strainer disposed within the upduct 172 and may be configured to separate solid debris from liquid as fluid and debris flow through the upduct 172 toward the recovery tank 108. In some embodiments, the debris separator 122 may include a strainer disposed within the lid 109 that separates solid debris from liquid as fluid and debris flow through the lid flow path from the first end to the second end of the lid 109. The strainer may comprise a screen having openings sized to allow liquid to pass through while retaining solid debris above a predetermined size, with the opening dimensions calibrated to provide effective separation while maintaining adequate flow rates through the system.

In some embodiments, the debris separator 122 may be a removable strainer disposed adjacent the end of the down duct 174. The removable configuration may enable users to access the strainer for periodic cleaning operations that remove accumulated debris. In some embodiments, the strainer is pivotably mounted to the lid 109 to pivot over and/or away from the end of the down duct 174. In some embodiments, the strainer is removably mounted within the recovery tank 108 (e.g., underneath the down duct 174) and is not connected to the lid 109. In some embodiments, the strainer may be constructed from a perforated material that resists corrosion and maintain structural integrity when exposed to various cleaning solutions. The perforated material may include screen openings that are sized to retain solid debris particles while allowing cleaning fluids and dissolved contaminants to pass through to the hollow interior of the recovery tank 108, preventing large debris from accumulating in the liquid storage volume. The debris separator 122 can thus serve as the debris collection chamber for storing debris to be removed from the cleaning device 100.

The systems, devices, and methods described herein are not limited to extraction cleaners. The systems, devices, and methods described herein can be similarly used with other types of cleaning devices having a tank configured to contain fluid.

In other aspects, a cleaning device is provided having a body including a suction nozzle, a suction source that can generate suction flow to draw fluid and debris into the suction nozzle, and a recovery tank removably coupled to the body. The recovery tank can receive and contain the drawn-in fluid and debris. The cleaning device also includes an upduct removably coupled to a front portion of the body and forming a fluid passage between the suction nozzle and the recovery tank such that the drawn-in fluid and debris passes from the suction nozzle to the recovery tank via the upduct. The upduct is curved such that the drawn-in fluid and debris enters an inlet of the upduct and exits an outlet of the upduct in different directions.

In some aspects, the outlet of the upduct is angled toward the recovery tank. In some aspects, the upduct is disposed between the recovery tank and the front portion of the body when both the upduct and the recovery tank are coupled to the body.

In some aspects, the upduct is illuminated by integrated lighting. In some aspects, the integrated lighting comprises LED lights.

In some aspects, the upduct has a first cross-sectional area at the inlet of the upduct and a second cross-sectional area at the outlet of the upduct, the second cross-sectional area being different from the first cross-sectional area.

In other aspects, a cleaning device is provided having a body including a suction nozzle, a suction source defining a portion of a suction pathway through the cleaning device, and a recovery tank removably coupled to the body that can receive and retain the drawn-in fluid and debris. The recovery tank defines a portion of the suction pathway. The cleaning device also includes a curved upduct removably coupled to a front portion of the body and defining a portion of the suction pathway. The suction source is downstream of the recovery tank, the recovery tank is downstream of the upduct, and the upduct is downstream of the suction nozzle.

In some aspects, the upduct extends upward from the suction nozzle and curves in front of the recovery tank. In some aspects, the upduct is disposed between the recovery tank and the front portion of the body when both the upduct and the recovery tank are coupled to the body.

In some aspects, the upduct includes integrated lighting. In some aspects, the integrated lighting comprises LED lights positioned along a length of the upduct.

In some aspects, the cleaning device further includes a down duct fluidly connected to the recovery tank and extending toward a tank interior of the recovery tank. In some aspects, the down duct is positioned at a rear portion of the tank interior and extends vertically downward to direct incoming fluid and debris toward a bottom of the recovery tank.

In some aspects, the cleaning device further includes a debris separator disposed along the suction pathway, the debris separator configured to separate solid debris from liquid as the solid debris and the liquid flow through the suction pathway. In some aspects, the debris separator comprises a strainer that is pivotably mounted to a lid of the recovery tank or removably mounted to the recovery tank.

In some aspects, the upduct has a first cross-sectional area at an inlet of the upduct and a second cross-sectional area at an outlet of the upduct, the second cross-sectional area being different from the first cross-sectional area.

In other aspects, a recovery tank is provided having a body defining a tank interior that can receive and store debris and fluid, the body defining an opening leading to the tank interior. The recovery tank further includes a lid removably disposed in the opening, the lid defining a lid pathway therethrough having a first end and a second end. The the recovery tank can be removably coupled to a cleaning device so that the first end of the lid pathway registers with a suction pathway of the cleaning device and the second end of the lid pathway registers with the tank interior, such that fluid and debris drawn into the cleaning device flow through the lid pathway from the first end to the second end before entering into the tank interior.

In some aspects, the lid pathway is fluidly coupled to a strainer configured to separate solid debris from liquid. In some aspects, the strainer includes a plurality of openings sized to allow liquid to pass through while retaining solid debris above a predetermined size. In some aspects, the strainer is removably disposed at an end of the lid pathway.

In some aspects, the recovery tank further includes a down duct fluidly connected to the second end of the lid pathway and extending downward toward the tank interior. In some aspects, the down duct is positioned at a rear portion of the tank interior and extends vertically downward from the lid.

In some aspects, the first end of the lid pathway is positioned at a front portion of the lid and the second end of the lid pathway is positioned at a rear portion of the lid.

In some aspects, the lid is fluidly coupled to an upduct of the cleaning device when the recovery tank is coupled to the cleaning device.

In other aspects, a recovery tank is provided having a body defining a hollow interior and an opening leading to the hollow interior. The hollow interior can receive and retain fluid and debris. The recovery tank also includes a lid that can removably cover the opening leading to the hollow interior, the lid defining a lid flow path therethrough in fluid communication with and upstream of the hollow interior when the lid is disposed in the opening. The recovery tank can couple to a cleaning device such that the lid flow path is in fluid communication with a suction pathway of the cleaning device and the hollow interior can receive fluid and debris from the cleaning device via the lid flow path.

In some aspects, the lid is fluidly coupled to a debris separator configured to separate solid debris from liquid. In some aspects, the debris separator includes a strainer having a plurality of openings sized to allow liquid to pass through while retaining solid debris above a predetermined size. In some aspects, the strainer is pivotally connected to the lid.

In some aspects, the recovery tank further includes a down duct fluidly connected to an outlet of the lid flow path and extending toward the hollow interior to direct incoming fluid and debris toward a bottom of the recovery tank. In some aspects, the down duct is positioned at a rear portion of the hollow interior and extends vertically downward from the lid.

In some aspects, the lid flow path has an inlet positioned at a front portion of the lid and an outlet positioned at a rear portion of the lid to create a defined pathway for fluid and debris movement through the lid.

In some aspects, the lid includes a coupling mechanism that can removably connect the lid to an upduct of the cleaning device, the coupling mechanism providing a sealed fluid connection between the upduct and the lid flow path.

In other aspects, a cleaning device is provided having an upright body including a suction source and a cleaning head coupled to the upright body. The cleaning head includes a first suction inlet fluidly coupled to the suction source and configured to draw in fluid and debris, a second suction inlet fluidly coupled to the suction source and configured to draw in fluid and debris, an agitator disposed between the first suction inlet and the second suction inlet, a diverter valve in fluid communication with the first suction inlet, the second suction inlet, and the suction source, the diverter valve movable between a first position in which the first suction inlet draws in a majority of the fluid and debris and a second position in which the second suction inlet draws in the majority of the fluid and debris, and an access hatch disposed on a bottom of the cleaning head proximate the diverter valve, the access hatch configured to provide direct access to the diverter valve.

In some aspects, the access hatch is removably secured using one or more fasteners. In some aspects, the fasteners include thumb screws, quarter-turn fasteners, or snap-fit mechanisms.

In some aspects, the access hatch includes sealing features configured to prevent debris infiltration into the diverter valve.

In some aspects, the first suction inlet is a nozzle suction inlet positioned at a bottom of the cleaning head and forward of the agitator. In some aspects, the second suction inlet is a chamber suction inlet positioned within an agitator chamber containing the agitator and extending through a wall of the agitator chamber.

In some aspects, the diverter valve is configured to move into the first position when the cleaning head is moved in a rearward direction and into the second position when the cleaning head is moved in a forward direction.

In other aspects, a cleaning device is provided having an upright body including a suction source, and a cleaning head coupled to the upright body. The cleaning head includes an agitator configured to agitate a surface to be cleaned, a first suction inlet disposed forward of the agitator and leading to a diverter valve, a second suction inlet disposed rearward of the agitator and leading to the diverter valve, and an access hatch disposed proximate the diverter valve and providing direct access thereto. The diverter valve is movable between a first position in which the first suction inlet is in fluid communication with the suction source and a second position in which the second suction inlet is in fluid communication with the suction source.

In some aspects, the access hatch is disposed on a bottom surface of the cleaning head and is secured using one or more fasteners. In some aspects, the fasteners comprise thumb screws, quarter-turn fasteners, or snap-fit mechanisms.

In some aspects, the first suction inlet is positioned at a bottom of the cleaning head and the second suction inlet is positioned rearward of the first suction inlet.

In some aspects, the access hatch forms at least a portion of a sealing face for the diverter valve.

In other aspects, a cleaning device is provided having a body including a fluid supply tank, a cleaning head operably coupled to the body and configured to move across a surface to be cleaned, and a manifold disposed within the cleaning head and fluidly coupled to the fluid supply tank. The manifold includes an inlet configured to receive fluid from the fluid supply tank, a channel fluidly coupled to the inlet and extending along a width of the manifold, at least one standpipe fluidly coupled to the channel and configured to emit air from the channel, and a plurality of nozzles in fluid communication with the channel and configured to emit fluid flowing through the channel.

In some aspects, the at least one standpipe extends at an angle of between 20 to 160 degrees from the channel.

In some aspects, the at least one standpipe is curved. In some aspects, the at least one standpipe has a degree of curvature of about 90 degrees.

In some aspects, the inlet comprises a barb configured to fluidly couple to a supply line from the fluid supply tank.

In some aspects, the at least one standpipe comprises a first standpipe disposed at a first end of the manifold and in fluid communication with a first end of the channel and a second standpipe disposed at a second end of the manifold and in fluid communication with a second end of the channel. In some aspects, the first standpipe and the second standpipe are each curved. In some aspects, the first standpipe and the second standpipe each extend at an angle of between about 20 to 160 degrees from the channel. In some aspects, the inlet is disposed between the first end and the second end of the channel.

In some aspects, a length of the at least one standpipe is proportional to an internal operating pressure of the manifold.

In other aspects, a cleaning device is provided having a body having a suction source and a fluid source disposed therein. A cleaning head is operably coupled to the body and defines at least one suction opening in fluid communication with the suction source. The cleaning head includes a wall, a channel extending along the wall and fluidly coupled to the fluid source, a plurality of nozzles fluidly coupled to the channel and configured to emit fluid onto a portion of the wall, and at least one hollow tube disposed along the channel and configured to vent air from the channel.

In some aspects, the at least one hollow tube comprises a first hollow tube disposed at a first end of the channel and a second hollow tube disposed at a second end of the channel. In some aspects, the first hollow tube and the second hollow tube are each curved. In some aspects, the first hollow tube and the second hollow tube each extend at an angle of between about 20 to 160 degrees from the channel.

In some aspects, the channel is fluidly coupled to the fluid source via a barb and a supply line leading to the fluid source. In some aspects, the barb is fluidly coupled to a portion of the channel between a first end and a second end of the channel. In some aspects, a length of the at least one hollow tube is proportional to an internal pressure of the wall.

The subject matter described herein can be implemented in analog electronic circuitry, digital electronic circuitry, and/or in computer software, firmware, or hardware, including the structural means disclosed in this specification and structural equivalents thereof or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor-readable recordable storage medium (e.g., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Certain exemplary implementations have been described to provide an overall understanding of the principles of the structure, function, manufacture, and use of the systems, devices, and methods disclosed herein. One or more examples of these implementations have been illustrated in the accompanying drawings. Those skilled in the art will understand that the systems, devices, and methods specifically described herein and illustrated in the accompanying drawings are non-limiting exemplary implementations and that the scope of the present invention is defined solely by the claims. The features illustrated or described in connection with one exemplary implementation may be combined with the features of other implementations. Such modifications and variations are intended to be included within the scope of the present invention. Further, in the present disclosure, like-named components of the implementations generally have similar features, and thus within a particular implementation each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described implementations. Accordingly, the present application is not to be limited by what has been particularly shown and described, except as indicated by the appended claims. All publications and references cited herein are expressly incorporated by reference in their entirety.

The invention claimed is:

1. A cleaning device, comprising:

a body;

a suction source; and a suction head operably coupled to the body and defining at least one suction opening in fluid communication with the suction source, the at least one suction opening being configured to intake debris from a surface to be cleaned, the suction head comprising:

a wall, an agitator configured to agitate the surface to be cleaned, and a fluid dispenser configured to dispense fluid within the suction head onto a portion of the wall prior to making contact with the surface to be cleaned, wherein a maximum width of the portion of the wall is greater than a maximum width of the agitator.

2. The cleaning device of claim 1, wherein the suction head further comprises a first suction inlet and a second suction inlet, both fluidly coupled to the suction source.

3. The cleaning device of claim 2, wherein the first suction inlet is disposed forward of the agitator and the second suction inlet is disposed rearward of the agitator.

4. The cleaning device of claim 1, wherein an angle between the portion of the wall and the surface to be cleaned is between about 0 to about 30 degrees.

5. The cleaning device of claim 1, wherein the fluid dispenser is disposed above the portion of the wall.

6. The cleaning device of claim 1, wherein the fluid dispenser is a first fluid dispenser and the suction head further comprises a second fluid dispenser, and wherein a width between the first fluid dispenser and the second fluid dispenser is less than the maximum width of the agitator.

7. The cleaning device of claim 1, wherein the fluid dispenser comprises a manifold cover and a plurality of spray nozzles integrated within the manifold cover.

8. The cleaning device of claim 7, wherein the manifold cover is configured to block at least a portion of the debris from reaching the plurality of spray nozzles.

9. A cleaning device, comprising:

an upright body; and a cleaning head operably coupled to the upright body, the cleaning head being configured to move across a surface to be cleaned and comprising:

at least one suction nozzle configured to draw in debris from the surface to be cleaned, an agitator disposed adjacent to the at least one suction nozzle, the agitator being configured to agitate the surface to be cleaned, and a fluid dispenser disposed at a first wall of the cleaning head and configured to dispense fluid onto a second wall of the cleaning head such that the dispensed fluid spreads over a width of the second wall prior to contacting the surface to be cleaned, the fluid dispenser comprising a manifold cover having a plurality of spray nozzles integrated therein, the spray nozzles being configured to dispense fluid onto the second wall.

10. The cleaning device of claim 9, wherein the second wall is curved and positioned vertically above the agitator such that the dispensed fluid flows downward via gravity from the first wall onto the second wall and onto the surface to be cleaned.

11. The cleaning device of claim 10, wherein the second wall extends longitudinally along a length of the agitator and includes one or more deflectors positioned beneath the fluid dispenser to promote lateral dispersion of the dispensed fluid.

12. The cleaning device of claim 9, wherein the spray nozzles are spaced apart to distribute fluid across the width of the second wall.

13. The cleaning device of claim 9, wherein a maximum width of the second wall is greater than a maximum width of the agitator.

14. The cleaning device of claim 13, wherein the fluid dispenser is a first fluid dispenser and the cleaning head further comprises a second fluid dispenser, and wherein a width between the first fluid dispenser and the second fluid dispenser is less than the maximum width of the agitator.

15. The cleaning device of claim 9, wherein the at least one suction nozzle comprises a first suction inlet disposed forward of the agitator and a second suction inlet disposed rearward of the agitator.

16. The cleaning device of claim 15, further comprising a diverter valve fluidly coupled to the first suction inlet and the second suction inlet, the diverter valve being selectively configurable to direct suction flow between the first suction inlet and the second suction inlet.

17. The cleaning device of claim 9, wherein the fluid dispenser is fluidly coupled to at least one standpipe configured to vent air.

* * * * *